US010837695B2

(12) United States Patent
Baum et al.

(10) Patent No.: US 10,837,695 B2
(45) Date of Patent: Nov. 17, 2020

(54) REFRIGERATOR ASSEMBLY

(71) Applicant: Electrolux Home Products, Inc., Charlotte, NC (US)

(72) Inventors: Chris Baum, Anderson, SC (US); Anthony Jenkins, Hendersonville, TN (US); Lori Burgener, Clarksville, TN (US); Rodrigo Panozzi, Curitiba (BR); Manjunath Shivamurty, Anderson, SC (US); Cristela Siebert, Curitiba (BR); Ivo Torres, Curitiba (BR); Charles Gascoyne, Orange (AU)

(73) Assignee: Electrolux Home Products, Inc., Charlotte, NC (US)

( * ) Notice: Subject to any disclaimer, the term of this patent is extended or adjusted under 35 U.S.C. 154(b) by 117 days.

(21) Appl. No.: 15/830,681

(22) Filed: Dec. 4, 2017

(65) Prior Publication Data

US 2019/0170427 A1 Jun. 6, 2019

(51) Int. Cl.
*F25D 23/02* (2006.01)
*F25D 23/06* (2006.01)
(Continued)

(52) U.S. Cl.
CPC ..... *F25D 23/028* (2013.01); *B67D 1/0857* (2013.01); *B67D 1/0895* (2013.01);
(Continued)

(58) Field of Classification Search
CPC .... F25D 23/028; F25D 23/023; F25D 23/087; F25D 23/062; F25D 2400/02;
(Continued)

(56) References Cited

U.S. PATENT DOCUMENTS 2,723,896 A * 11/1955 Wurtz ..... E05C 19/161 312/296
3,359,053 A * 12/1967 Hagendoorn ..... F25D 23/082 312/296

(Continued)

FOREIGN PATENT DOCUMENTS

CN 102353220 2/2012
CN 107036376 8/2017

(Continued)

OTHER PUBLICATIONS

International Search Report for PCT/US2018/063576, dated Jul. 31, 2019, 3 pages.

*Primary Examiner* — Paul Alvare
*Assistant Examiner* — Kirstin U Oswald
(74) *Attorney, Agent, or Firm* — Peame & Gordon LLP

(57) ABSTRACT

A refrigerator assembly includes a cabinet defining a storage compartment and a door for providing selective access to the storage compartment. The refrigerator assembly further includes a mullion assembly having a hinge coupled to the door and a flipper mullion pivotally attached to the hinge. The flipper mullion is rotatable between a first position, a second position, and an intermediate position that is intermediate the first and second positions. The mullion assembly further includes a spring configured to bias the flipper mullion toward the first position when the flipper mullion is between the first position and the intermediate position. The spring is further configured to bias the flipper mullion toward the second position when the flipper mullion is between the second position and the intermediate position. The mullion assembly further includes a magnetic assembly configured to bias the flipper mullion toward the second position.

24 Claims, 26 Drawing Sheets

(51) Int. Cl.
*B67D 1/08* (2006.01)
*F25D 23/08* (2006.01)

(52) U.S. Cl.
CPC ..... *F25D 23/023* (2013.01); *F25D 23/062* (2013.01); *F25D 23/087* (2013.01); *F25D 2323/021* (2013.01); *F25D 2323/024* (2013.01); *F25D 2331/806* (2013.01); *F25D 2400/02* (2013.01); *F25D 2400/06* (2013.01)

(58) Field of Classification Search
CPC ..... F25D 2331/806; F25D 2400/06; F25D 2323/024; F25D 2323/021; B67D 1/0895; B67D 1/0857; Y10T 16/5401; E05Y 2201/46
USPC ..... 62/440; 312/401, 402, 326, 329, 405, 312/406.1, 406.2, 407, 407.1; 16/320
See application file for complete search history.

(56) References Cited

U.S. PATENT DOCUMENTS 3,612,848 A * 10/1971 Koch ..... A47B 96/04 362/92
4,106,238 A * 8/1978 Bonello ..... E05D 7/02 16/243
4,170,391 A * 10/1979 Bottger ..... E05D 3/04 248/222.11
4,226,489 A * 10/1980 Haag ..... E05C 19/161 312/296
4,288,135 A * 9/1981 Buchser ..... F25D 23/028 312/296
4,543,800 A * 10/1985 Mawby ..... E05D 11/0081 439/165
4,711,098 A * 12/1987 Kuwabara ..... F25D 11/022 312/321.5
4,884,415 A * 12/1989 Mandel ..... F25D 21/04 62/277
4,912,942 A * 4/1990 Katterhenry ..... F25D 23/028 403/71
5,309,680 A * 5/1994 Kiel ..... E05C 19/161 49/368
5,411,328 A * 5/1995 You ..... F25D 23/028 312/405
5,417,272 A * 5/1995 Marlowe ..... A47K 3/362 160/202
7,008,032 B2 * 3/2006 Chekal ..... F25D 11/02 312/405
7,659,491 B2 * 2/2010 Yang ..... F25D 21/04 219/201
7,726,756 B2 * 6/2010 Fu ..... F25D 23/069 312/401
8,167,389 B2 * 5/2012 Han ..... F25D 23/02 16/250
8,292,383 B2 * 10/2012 Laible ..... E05B 65/0042 312/405
8,523,303 B2 * 9/2013 Arslankiray ..... F25D 23/02 312/293.1
9,157,676 B2 * 10/2015 Lee ..... F25D 23/028
9,188,382 B2 * 11/2015 Kim ..... F25D 21/04
9,234,695 B1 1/2016 Dubina
9,709,316 B2 * 7/2017 Miersen ..... F25D 23/087
9,995,528 B1 * 6/2018 Ebrom ..... F25D 29/00
2005/0046319 A1 * 3/2005 Chekal ..... F25D 11/02 312/401
2006/0080995 A1 * 4/2006 An ..... F25D 23/028 62/441
2006/0144066 A1 * 7/2006 Lee ..... F25D 23/12 62/238.6
2006/0152126 A1 * 7/2006 Collins ..... F25D 23/063 312/407
2006/0196214 A1 * 9/2006 Lee ..... F25D 17/065 62/344
2007/0125002 A1 * 6/2007 Linkmeyer ..... F25D 23/087 49/368
2007/0151077 A1 * 7/2007 Wei ..... E05D 3/02 16/320
2008/0209812 A1 * 9/2008 Lancry ..... F25D 21/04 49/316
2009/0113927 A1 * 5/2009 Laible ..... F25D 23/028 62/449
2009/0273264 A1 * 11/2009 Butler ..... F25D 23/028 312/405
2009/0320509 A1 * 12/2009 Gorz ..... F25D 23/02 62/264
2010/0071404 A1 * 3/2010 Han ..... F25D 23/02 62/441
2012/0073321 A1 * 3/2012 Davis ..... F25D 23/028 62/449
2013/0104586 A1 * 5/2013 Krause ..... B67D 1/07 62/275
2013/0241385 A1 * 9/2013 Lee ..... F16J 15/3232 312/404
2013/0241386 A1 * 9/2013 Kim ..... F25D 23/028 312/404
2013/0327069 A1 * 12/2013 Styn ..... F25C 5/22 62/71
2014/0159560 A1 * 6/2014 Jung ..... F25D 23/02 312/405
2014/0217877 A1 * 8/2014 Miersen ..... F25D 23/087 312/405
2014/0265804 A1 * 9/2014 Wilson ..... F25D 23/028 312/405
2014/0268648 A1 * 9/2014 Gomes ..... F21V 33/0044 362/94
2014/0375198 A1 * 12/2014 Jeon ..... F25D 25/02 312/404
2015/0015133 A1 * 1/2015 Carbajal ..... A47F 3/04 312/405
2016/0047153 A1 * 2/2016 Kadus ..... E05D 11/0054 16/250
2016/0060932 A1 * 3/2016 Stuart ..... E05D 3/022 16/54
2016/0313050 A1 * 10/2016 Yoon ..... F25D 23/028

FOREIGN PATENT DOCUMENTS

EP 2857779 4/2015
JP 2014020572 2/2014
WO 2009109878 9/2009

* cited by examiner

REFRIGERATOR ASSEMBLY

FIELD

The present disclosure relates generally to a refrigerator assembly, and, more particularly, to a refrigerator assembly having at least one of a mullion assembly, a dispenser assembly, a vented container, and a hinge assembly.

BACKGROUND

A refrigerator can comprise a cabinet defining one or more storage compartments such as an upper storage compartment and a lower storage compartment. The refrigerator can further comprise one or more doors for providing selective access to the one or more storage compartments. In some examples, the door(s) can be pivotally attached to the cabinet using a hinge assembly. In examples wherein two French doors are pivotally attached to the cabinet, a mullion assembly can be attached to one of the doors such that when both doors are closed, a body of the mullion assembly will be located in a space between the two doors so as to obstruct air from passing between the two doors and provide a seal between the two doors. In some examples, the refrigerator assembly can include a dispenser for water and/or ice that is provided on one of its doors. Moreover, in some examples, the refrigerator assembly can include a container within its storage compartment(s) for storing food items.

BRIEF SUMMARY

The following presents a simplified summary of the invention in order to provide a basic understanding of some example aspects of the invention. This summary is not an extensive overview of the invention. Moreover, this summary is not intended to identify critical elements of the invention nor delineate the scope of the invention. The sole purpose of the summary is to present some concepts of the invention in simplified form as a prelude to the more detailed description that is presented later.

In accordance with a first aspect, a refrigerator assembly includes a cabinet defining a storage compartment and a door for providing selective access to the storage compartment. The door is pivotally attached to the cabinet such that the door is rotatable between an open position and a closed position. The refrigerator assembly further includes a mullion assembly having a hinge coupled to the door and a flipper mullion pivotally attached to the hinge such that the flipper mullion is rotatable relative to the hinge about an axis. The flipper mullion is rotatable between a first position, a second position, and an intermediate position that is intermediate the first and second positions. The mullion assembly further includes a spring configured to bias the flipper mullion toward the first position when the flipper mullion is between the first position and the intermediate position. The spring is further configured to bias the flipper mullion toward the second position when the flipper mullion is between the second position and the intermediate position. The mullion assembly further includes a magnetic assembly configured to bias the flipper mullion toward the second position.

In accordance with a second aspect, a mullion assembly includes a hinge and a flipper mullion pivotally attached to the hinge such that the flipper mullion is rotatable relative to the hinge about an axis. The flipper mullion is rotatable between a first position, a second position, and an intermediate position that is intermediate the first and second positions. The mullion assembly further includes a spring configured to bias the flipper mullion toward the first position when the flipper mullion is between the first position and the intermediate position. The spring is further configured to bias the flipper mullion toward the second position when the flipper mullion is between the second position and the intermediate position. The mullion assembly further includes a magnetic assembly configured to bias the flipper mullion toward the second position.

In accordance with a third aspect, a refrigerator assembly includes a cabinet defining at least one storage compartment and a pair of doors for providing selective access to the at least one storage compartment, the pair of doors including a first door and a second door. The refrigerator assembly further includes at least one hinge and a flipper mullion pivotally attachable to the at least one hinge. The mullion assembly is changeable between a first configuration wherein the flipper mullion is pivotally attached to the first door and a second configuration wherein the flipper mullion is pivotally attached to the second door.

In accordance with a fourth aspect, a refrigerator assembly includes a cabinet defining a storage compartment and a door moveably attached to the cabinet for providing selective access to the storage compartment. The refrigerator assembly further includes a dispenser assembly for dispensing water or ice, the dispenser assembly having an outlet provided on the door and a supply system configured to selectively supply water or ice to the outlet. The refrigerator assembly further includes an induction assembly having a first induction element provided on the cabinet and a second induction element provided on the door. The induction assembly is configured to provide an inductive coupling between the first element and the second element that induces a current in the dispenser assembly.

BRIEF DESCRIPTION OF THE DRAWINGS

The foregoing and other aspects will become apparent to those skilled in the art to which the present examples relate upon reading the following description with reference to the accompanying drawings, in which.

DETAILED DESCRIPTION

Figure 1:
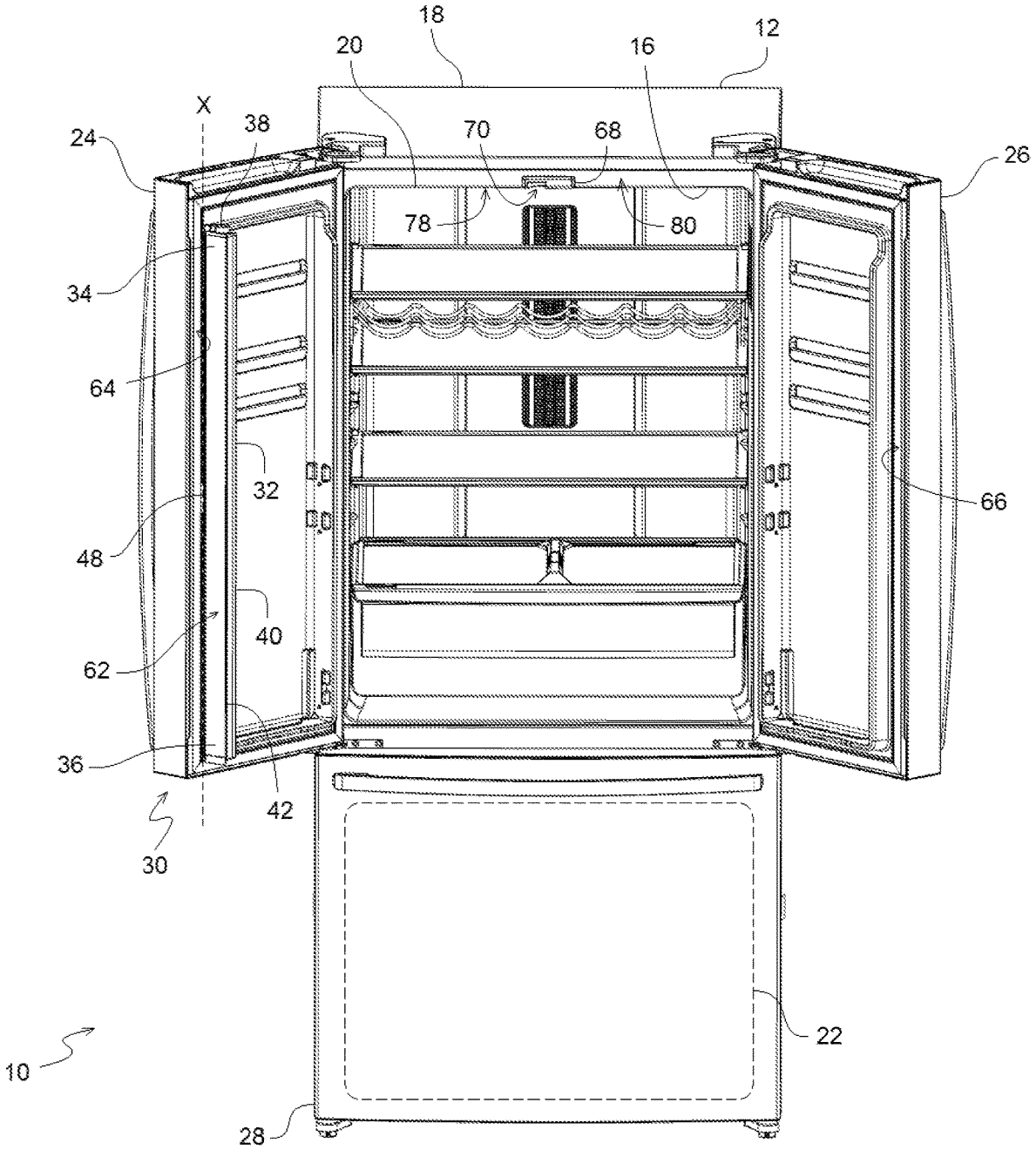
FIG. 1 is a front view of an example refrigerator assembly with a mullion assembly that is assembled according to a first configuration.

Example embodiments that incorporate one or more aspects are described and illustrated in the drawings. These illustrated examples are not intended to be a limitation on the present examples. For example, one or more aspects can be utilized in other embodiments and even other types of devices. Moreover, certain terminology is used herein for convenience only and is not to be taken as a limitation on the present examples. Still further, in the drawings, the same reference numerals can be employed for designating the same elements.

Referring to FIG. 1, an example refrigerator assembly 10 is shown. The refrigerator assembly 10 includes a cabinet 12 comprising at least one compartment liner 16 and a shell 18 that surrounds the compartment liner 16. Insulation can be provided within any spacing between the shell 18 and the compartment liner 16. The compartment liner 16 can define one or more storage compartments such as, for example, a first storage compartment 20 and a second storage compartment 22. In the illustrated example, the first and second storage compartments 20, 22 are vertically aligned and respectively correspond to a fresh food compartment and a freezer compartment. However, the first and second storage compartments 20, 22 may be arranged side-by-side in some examples. Moreover, the first and second storage compartments 20, 22 in some examples may correspond to other types of compartments. Additionally, the first and second storage compartments 20, 22, and their corresponding doors, may be symmetrical or asymmetrical.

The refrigerator assembly 10 can comprise one or more doors to provide selective access to one or more of its storage compartments. In the present example, the refrigerator assembly 10 comprises two French doors 24, 26 that provide selective access to the first storage compartment 20 and a sliding door 28 for providing selective access to the second storage compartment 22. The French doors 24, 26 are pivotally attached to the cabinet 12 such that each door 24, 26 is rotatable between an open and a closed position to provide selective access to a portion of the first storage compartment 20. Meanwhile, the sliding door 28 is slidably attached to the cabinet 12 such that the door 28 can slide between an open and closed position. However, the refrigerator assembly 10 is not limited to the door and storage compartment configuration shown in FIG. 1. For instance, in some examples, the French doors 24, 26 may provide selective access to both the first and second storage compartments 20, 22. As another example, in embodiments wherein the first and second storage compartments 20, 22 are arranged side-by-side, the left door 24 may provide selective access to one storage compartment while the right door 26 provides selective access to the other storage compartment. As yet another example, the refrigerator assembly 10 may comprise a single storage compartment and a single door or two French doors that provide(s) selective access to the single storage compartment. Accordingly, it is to be appreciated that the refrigerator assembly 10 shown in FIG. 1 illustrates only one possible example, as any number of designs and configurations are contemplated.

Figure 2:
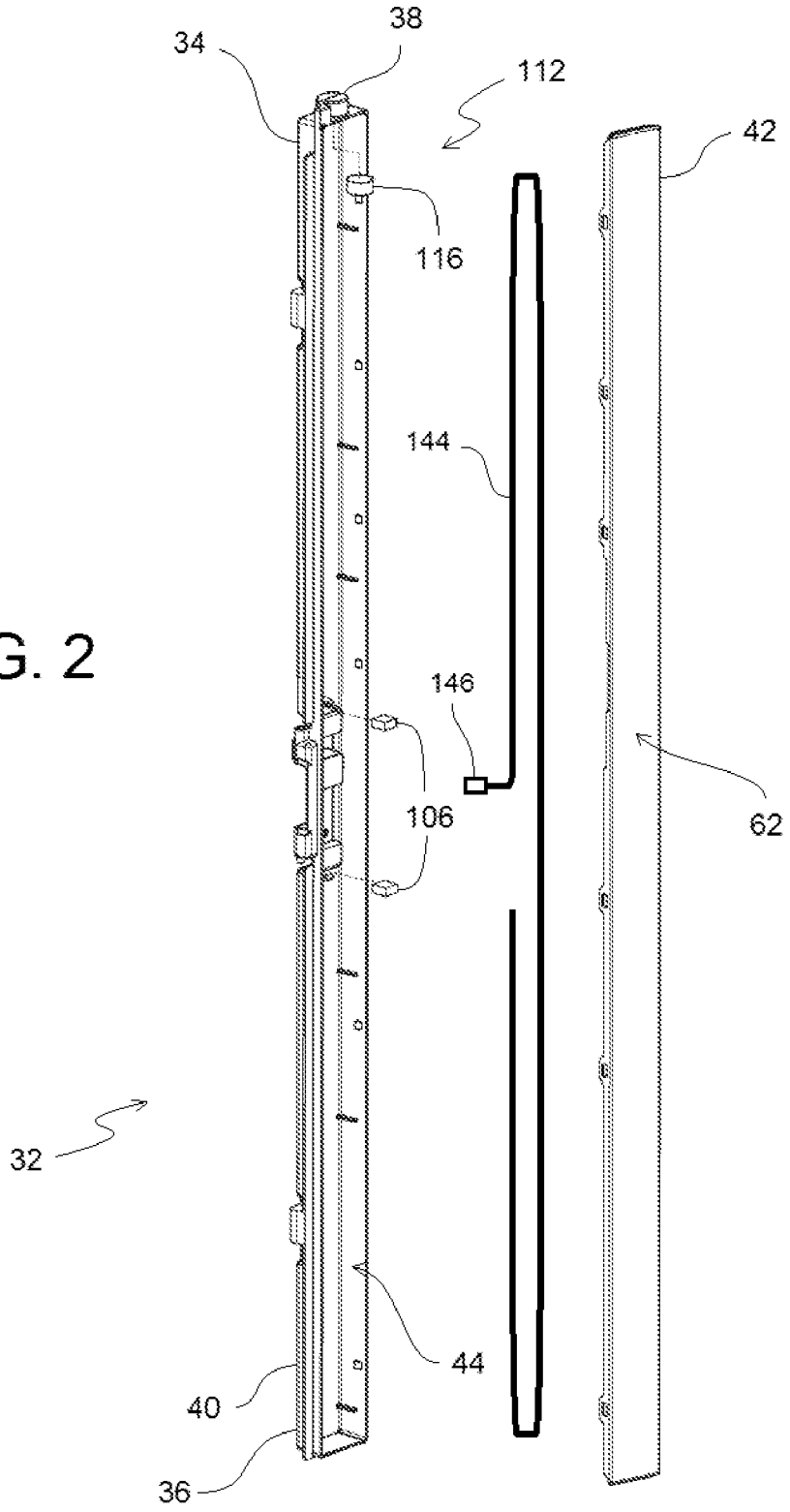
FIG. 2 is an exploded view of a flipper mullion of the mullion assembly.

The refrigerator assembly 10 in some examples may comprise a mullion assembly 30 for providing improved sealing of its doors 24, 26. The mullion assembly 30 includes a flipper mullion 32 that can be pivotally attached to one of the two doors 24, 26. The flipper mullion 32 can be an elongated body that extends vertically along the length of the doors 24, 26. The flipper mullion 32 has two ends 34, 36 and comprises a mullion guide 38 provided at one or both ends 34, 36 of the flipper mullion 32. The flipper mullion 32 can be formed as a single structure or the flipper mullion 32 can comprise multiple, separate components that are separately attached to each other. For example, as shown in FIG. 2, the flipper mullion 32 can comprise a casing 40 and a cover 42 that can be removably attached to each other to define an enclosure 44. The mullion guide(s) 38 can be formed with the casing 40 or cover 42 or the mullion guide(s) 38 can be separately attached to the casing 40 and/or cover 42.

As noted above, the flipper mullion 32 can be pivotally attached to one of the two doors 24, 26. An embodiment of the mullion assembly 30 will now be described wherein the flipper mullion 32 is pivotally attached to the left door 24. However, it is to be appreciated that the flipper mullion 32 may be pivotally attached to the right door 26 in a similar manner using structure that is similar and/or mirrored to the structure described in the embodiment below. Moreover, as will be discussed further below, the mullion assembly 30 in some embodiments may be changeable between a first configuration wherein the flipper mullion 32 is pivotally attached to the left door 24 and a second configuration wherein the flipper mullion 32 is pivotally attached to the right door 26.

More specifically, as shown in FIGS. 3-6, the mullion assembly 30 can comprise a hinge 48 for pivotally coupling the flipper mullion 32 to the left door 24. The hinge 48 may be integral with the left door 24 or the hinge 48 may be separately attached to the door 24. In the present embodiment, the hinge 48 is a bracket that includes a first side 50 and an opposing second side 52 and can be removably attached to the left door 24 such that the first side 50 faces the flipper mullion 32 and the second side 52 faces away from the flipper mullion 32 and towards a mounting surface 54 of the door 24. The hinge 48 can be removably attached to the left door 24 using various means such as threads, fasteners, hooks, clips, or other means of removably attaching two separate parts.

Figure 5:
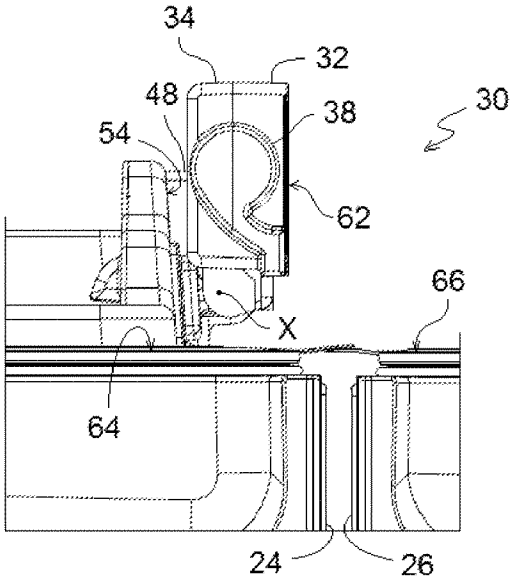
FIG. 5 is a view of the mullion assembly assembled according to the first configuration with the flipper mullion in a second position.
Figure 4:
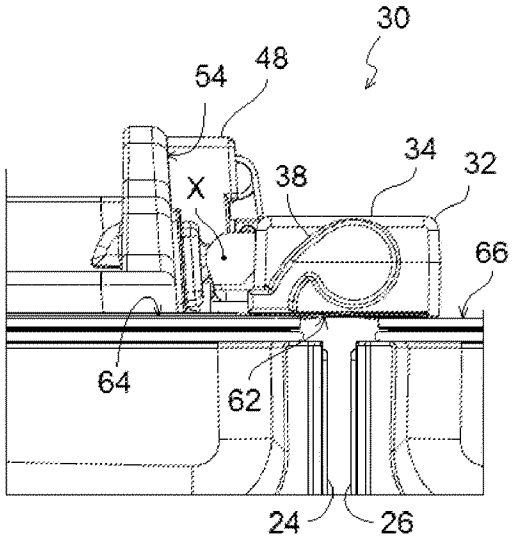
FIG. 4 is a view of the mullion assembly assembled according to the first configuration with the flipper mullion in a first position.
Figure 6:
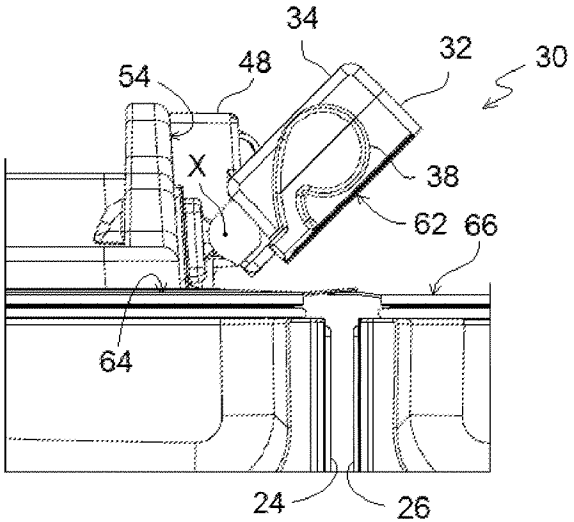
FIG. 6 is a view of the mullion assembly assembled according to the first configuration with the flipper mullion in an intermediate position.

The flipper mullion 32 can be pivotally attached to the hinge 48 such that the flipper mullion 32 is rotatable relative to the hinge 48 about an axis X. More specifically, the flipper mullion 32 can be rotatable between a first position (as shown in FIG. 4), a second position (as shown in FIG. 5), and an intermediate position that is intermediate the first and second positions (as shown in FIG. 6). When in the first position, a face 62 of the flipper mullion 32 will be substantially parallel to a rear surface 64 of the left door 24 and will preferably abut the rear surface 64 of the door, and/or a seal carried thereon. Moreover, when both doors 24, 26 are in the closed positon, the face 62 will also abut and be substantially parallel to a rear surface 66 of the right door 26 to likewise abut the rear surface 66 and/or a seal carried thereon. Accordingly, when both doors 24, 26 are in the closed positon and the flipper mullion 32 is in the first position, the flipper mullion 32 can provide a seal between the two doors 24, 26 that obstructs air from passing between the two doors 24, 26.

As can be seen in FIG. 4, when the flipper mullion 32 is in the first position and the right door 26 is closed, the right door 26 can obstruct opening and closing of the left door 24 due to the extension of the flipper mullion 32. Accordingly, the flipper mullion 32 can be rotated to the second position (shown in FIG. 5) to permit the left door 24 to be moved in or out of its closed position while the right door 26 remains in the closed position. More specifically, the flipper mullion 32 can be rotated approximately 90 degrees about the axis X to the second position such that the face 62 of the flipper mullion 32 is substantially perpendicular to the rear surface 64 of the left door 24, though other angles are possible.

In the intermediate position, the face 62 of the flipper mullion 32 can be transverse to the rear surface 64 of the left door 24 at an angle that is somewhere between perpendicular and parallel of the rear surface 64 (e.g., 45 degrees). It is to be appreciated that due to the pivoting motion of the flipper mullion, the intermediate position will include a continuum of angles that the flipper mullion moves through while transitioning in a generally continuous manner between the first and second positions.

Figure 7:
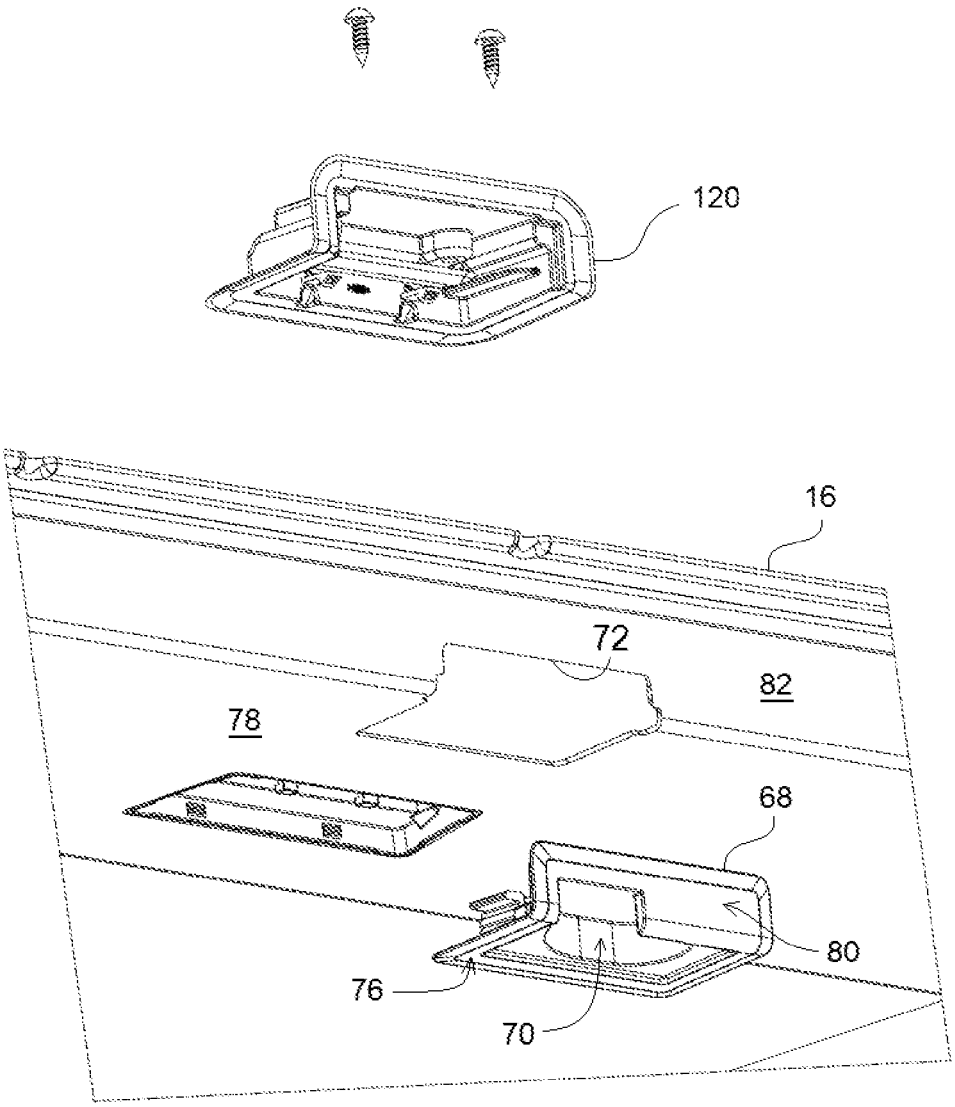
FIG. 7 is a partial exploded view of a first guide element and compartment liner of the example refrigerator assembly.
Figure 8:
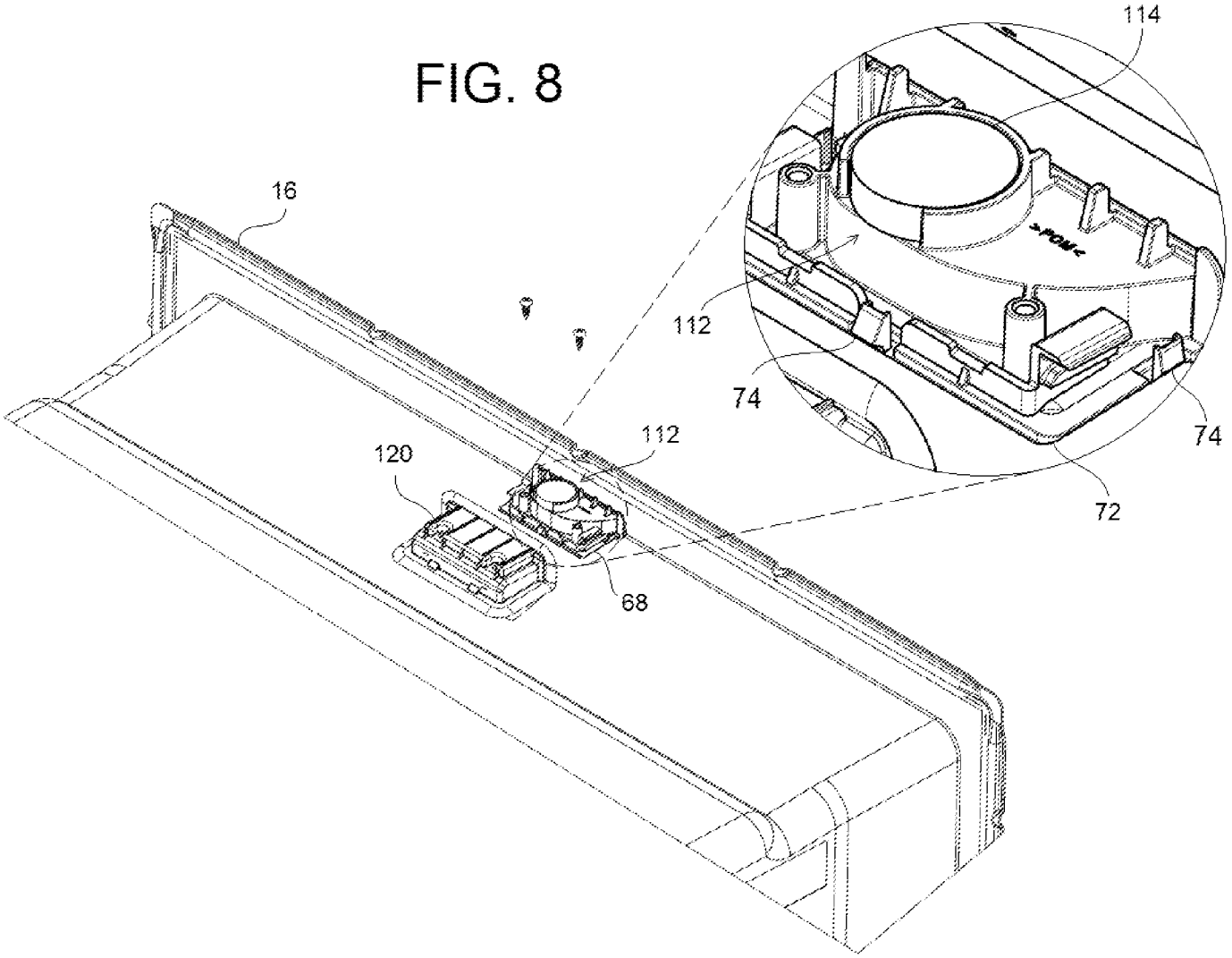
FIG. 8 is a perspective view of the first guide element coupled to the compartment liner.

Turning now to FIGS. 7 & 8, in some embodiments, the refrigerator assembly 10 can comprise a cabinet guide 68 defining a recess 70 that is configured to guide the flipper mullion 32 between its first and second positions as the left door 24 is rotated between its closed position and open position. When the door 24 is in the closed position, the mullion guide 38 of the flipper mullion 32 will be located within the recess 70 and the flipper mullion 32 will be aligned in the first position such that the face 62 of the flipper mullion 32 abuts and is substantially parallel to the rear surface 64 of the door 24 and/or a seal carried thereon. As discussed above, in this position, the flipper mullion 32 can provide a seal between the doors 24, 26 when both doors 24, 26 are in the closed position. As the left door 24 is rotated from its closed position to its open position, the contours of the cabinet guide 68 that define the recess 70 will guide the mullion guide 38 of flipper mullion 32 via a cam action such that the flipper mullion 32 rotates from its first position to its second position. Thus, the cabinet guide 68 can guide the flipper mullion 32 to the second position to permit opening of the left door 24 while the right door 26 is closed. Once opened, the flipper mullion 32 can remain in the second position so that when the left door 24 is later rotated to its closed position, the right door 26 can remain in its closed position without obstructing closing of the left door 24. As the left door 24 is moved to its closed position, the mullion guide 38 of the flipper mullion 32 will engage the recess 70 of the cabinet guide 68, which will guide the mullion guide 38 in a cam action such that the flipper mullion 32 rotates from the second position (or any position intermediate the first and second positions that the flipper mullion 32 may be in) back to the first position.

The cabinet guide 68 can be integrally formed with the compartment liner 16 or some other portion of the cabinet 12. Alternatively, the cabinet guide 68 may be separately attached to the cabinet 12. For instance, in some examples, the compartment liner 16 of the cabinet 12 can comprise a cutout portion 72 and the cabinet guide 68 can be inserted within the cutout portion 72 and removably attached to the compartment liner 16. Preferably, the cabinet guide 68 is coupled to the compartment liner 16 using connecting structure such as one or more latch members 74 that are located on an interior side of the compartment liner 16 (e.g., between the compartment liner 16 and the shell 18) so that the latch members 74 are not viewable from the exterior of the cabinet 12. Moreover, the cabinet guide 68 is preferably attached to the compartment liner 16 such that the cabinet guide 68 is flush with a surface of the compartment liner 16. For example, a lower surface 76 of the cabinet guide 68 can be flush with an upper compartment surface 78 of the compartment liner 16 and a front surface 80 of the cabinet guide 68 can be flush with a front flange surface 82 of the compartment liner 16. Attaching the cabinet guide 68 flush to the compartment liner 16 using internally located connecting structure can provide an aesthetically pleasing look. However, it is to be appreciated the cabinet guide 68 in some examples may be attached to the cabinet 12 using externally visible connecting structure and/or may not be flush with the cabinet 12 in some examples.

To prevent over-rotation of the flipper mullion 32 from the first position past the second position when the door 26 is opened, the mullion assembly 30 can comprise a bumper 84 (shown in FIG. 3) that is configured to inhibit movement of the flipper mullion 32 past the second position in a direction away from the first position. The bumper 84 can be coupled (e.g., integral or separately connected) to one of the flipper mullion 32 and the hinge 48 and can be configured to contact the other of the flipper mullion 32 and the hinge 48 when the flipper mullion 32 reaches the second position, thereby preventing further rotation of the flipper mullion 32. The bumper 84 can comprise rubber or some other soft material that can help mitigate any damage that may be caused when the bumper 84 contacts the flipper mullion 32 or hinge 48.

Figure 3:
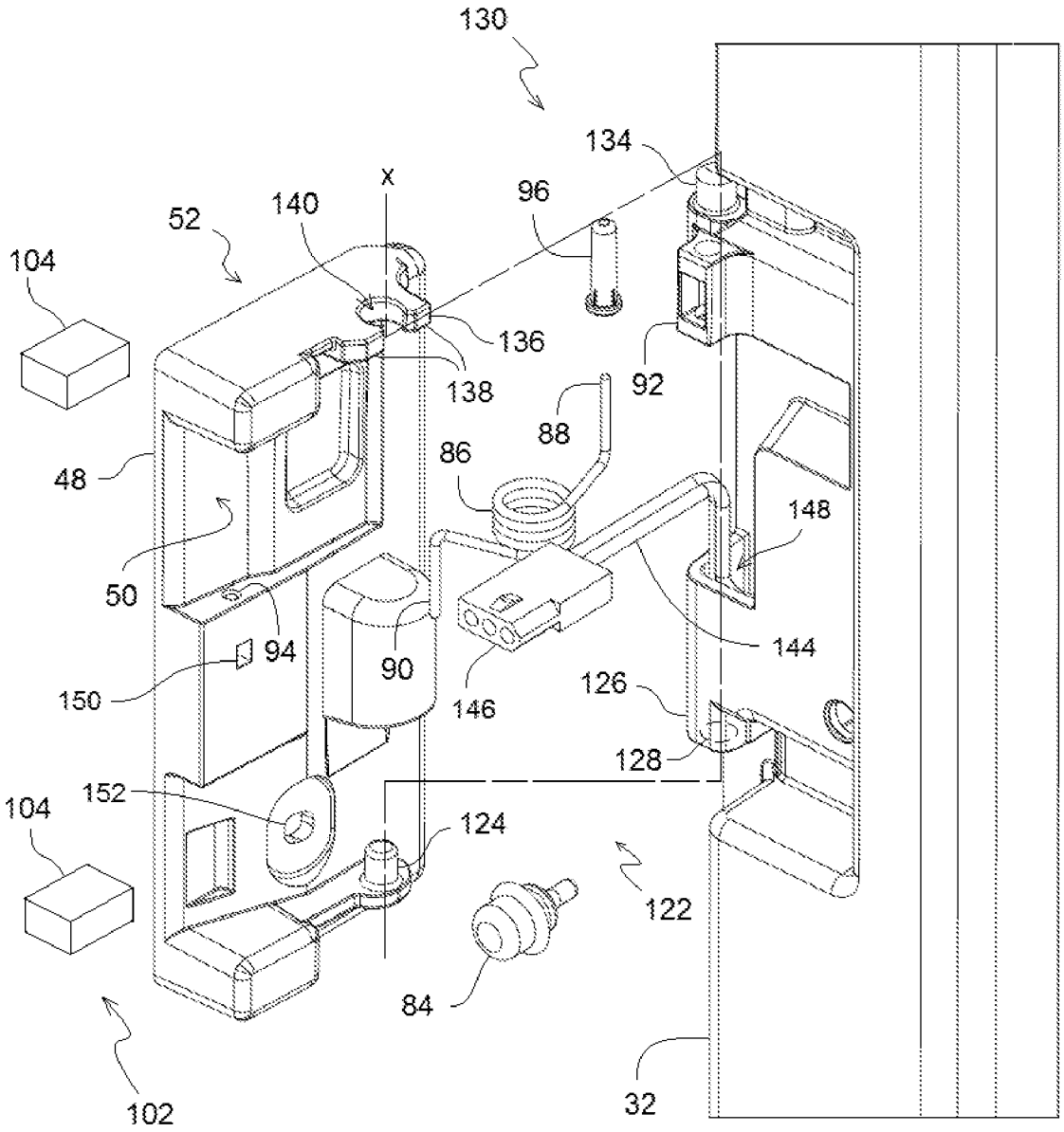
FIG. 3 is an exploded view of the mullion assembly with the flipper mullion and a hinge arranged according to the first configuration.

To assist in moving the flipper mullion 32 between its first and second positions and holding the flipper mullion 32 in said positions, the mullion assembly 30 can further comprise one or more biasing members that bias the flipper mullion 32 toward the first and/or second positions. For example, in some embodiments, the mullion assembly 30 can comprise a spring 86, as shown in FIG. 3. The spring 86 can comprise a first end portion 88 and a second end portion 90 that can be respectively mounted to the flipper mullion 32 and hinge 48, or vice versa. For instance, the first end portion 88 can be mounted within a receiving portion 92 of the flipper mullion 32 and the second end portion 90 can be mounted within a receiving portion 94 of the hinge 48. In some examples, one or both of the first and second end portions 88, 90 can be mounted within its corresponding receiving portion either directly or indirectly using a bearing sleeve that provides an interface between the end portion and receiving portion. For instance, as shown in the present example, the second end portion 90 is mounted directly within the receiving portion 94 of the hinge 48. Meanwhile, the first end portion 88 is mounted indirectly using a bearing sleeve 96 that is inserted within the receiving portion 92 of the flipper mullion 32 and provides an interface between the first end portion 88 the receiving portion 92. The bearing sleeve 96 can comprise a self-lubricating material such as nylon that can help provide a smooth engagement between the bearing sleeve 96 and the spring 86. The bearing sleeve 96 can be particularly useful for embodiments wherein the flipper mullion 32 comprises a non-self-lubricating material such as ABS.

The spring 86 can be a snap-over center spring, torsion spring, a compression spring, an extension spring or some other type of spring member that is designed to bias the flipper mullion toward its first and/or second positions. In some examples, the spring 86 will bias the flipper mullion 32 toward the first position when the flipper mullion 32 is between the first position and the intermediate position. Likewise, the spring 86 will bias the flipper mullion 32 toward the second position when the flipper mullion 32 is between the second position and the intermediate position. As such, the spring 86 can help bias and hold the flipper mullion 32 in either of the first and second positions.

In some embodiments, the mullion assembly 30 can further comprise a magnetic assembly 102 configured to bias the flipper mullion 32 toward the second position and help hold the flipper mullion 32 in said position. The magnetic assembly 102 can comprise one or more magnetic hinge bodies 104 (shown in FIG. 3) that are coupled to the hinge 48 and one or more magnetic mullion bodies 106 (shown in FIG. 2) that are coupled to the flipper mullion 32 and correspond to the one or more magnetic hinge bodies 104. When the flipper mullion 32 is sufficiently close to the second position to be attracted by the magnetic force, the magnetic hinge bodies 104 can be magnetically coupled to their corresponding magnetic mullion bodies 106 such that the flipper mullion 32 will be biased toward the second position and can be held in said position by the magnetic coupling.

Figure 9:
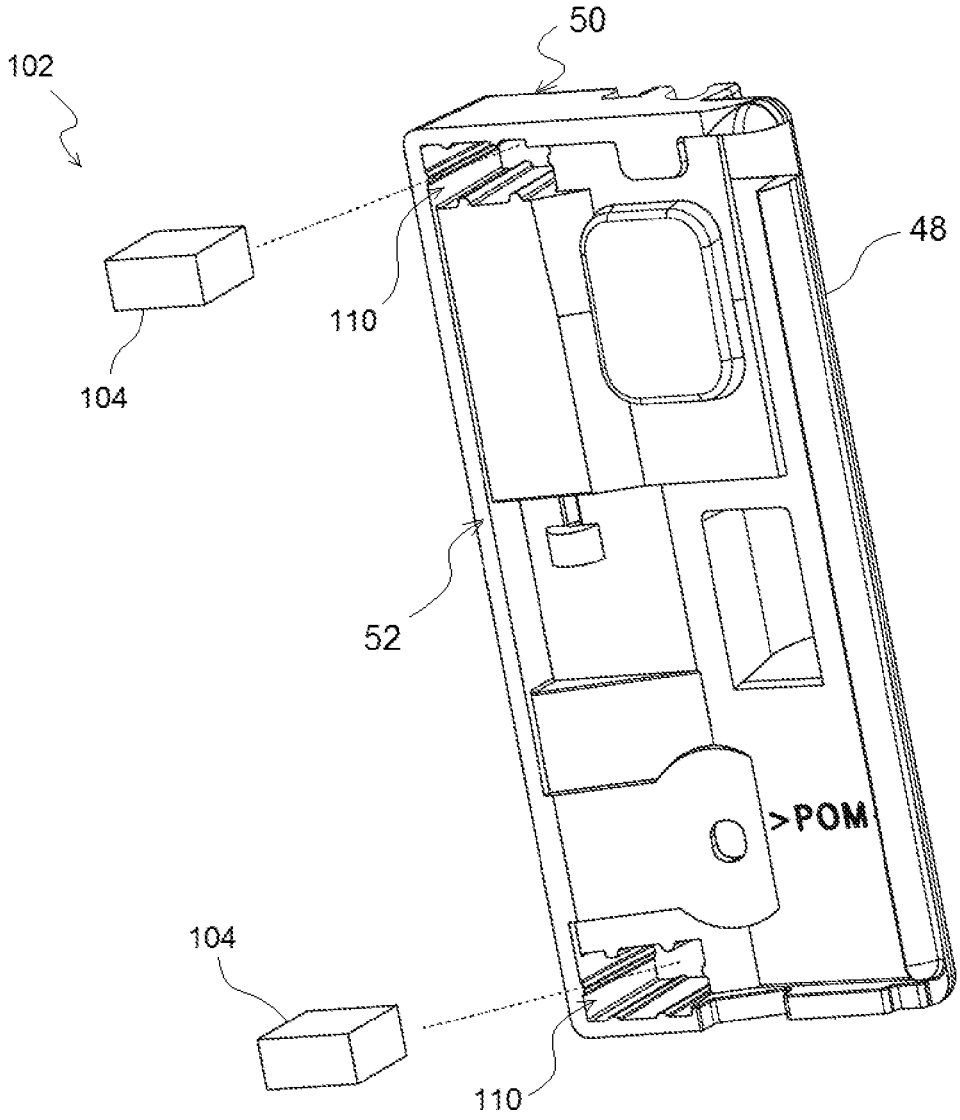
FIG. 9 is an exploded view of the hinge and magnetic hinge bodies of the mullion assembly.

The one or more magnetic hinge bodies 104 can be provided within corresponding recesses 110 defined by the second side 52 of the hinge 48, as shown in FIG. 9. Thus, when the hinge 48 is coupled to the left door 24 with the second side 52 of the hinge 48 facing the mounting surface 54 of the door 24, the magnetic hinge bodies 104 will be enclosed by the hinge 48 and the door 24, thereby concealing the magnetic hinge bodies 104 from view and protecting the magnetic hinge bodies 104 from damage or debris. Similarly, the one or more magnetic mullion bodies 106 can be provided within the enclosure 44 defined by the casing 40 and cover 42 of the flipper mullion 32 (as shown in FIG. 2), thereby concealing the magnetic mullion bodies 106 from view and protecting the magnetic mullion bodies 106 from damage or debris.

In some embodiments, the mullion assembly 30 can additionally or alternatively comprise a magnetic assembly 112 configured to bias the flipper mullion 32 toward the first position and help hold the flipper mullion 32 in said position. The magnetic assembly 112 can comprise one or more magnetic cabinet bodies 114 (see e.g., FIG. 8) coupled to the cabinet 12 and one or more magnetic mullion bodies 116 (see e.g., FIG. 2) coupled to the flipper mullion 32 that correspond to the one or more magnetic cabinet bodies 114. When the left door 24 is rotated towards the closed position, the magnetic assembly 112 will provide a magnetic coupling that biases the flipper mullion 32 toward the first position.

As shown in FIG. 8, a magnetic cabinet body 114 can be coupled to an internal side of the cabinet guide 68 such that the magnetic cabinet body 114 will be enclosed by the cabinet guide 68 and the compartment liner 16 and shell 18 of the cabinet 12, thereby concealing the magnetic cabinet body 114 from view and protecting the magnetic cabinet body 114 from damage or debris. Moreover, a cover 120 can be further coupled to the internal side of the cabinet guide 68 to protect the magnetic cabinet body 114 from damage or debris. When coupled to the cabinet guide 68, the cover 120 can be sized such that the cabinet guide 68 and coupled cover 120 cannot be removed from the cutout portion 72 without decoupling the cover 120 from the cabinet guide 68.

As shown in FIG. 2, a corresponding magnetic mullion body 116 can be provided near the end 34 of the flipper mullion 32 within its enclosure 44, thereby concealing the magnetic mullion body 116 from view and protecting the magnetic mullion body 116 from damage or debris. More specifically, the magnetic mullion body 116 can be provided within a portion of the casing 40 that forms the mullion guide 38 at the end 34 of the flipper mullion 32. When provided in such a location, the magnetic mullion body 116 will be close to its corresponding magnetic cabinet body 114 when the mullion guide 38 engages the cabinet guide 68 to form a strong magnetic coupling between the magnetic mullion body 116 and the magnetic cabinet body 114.

As described above, the mullion assembly 30 can comprise the spring 86 and optionally can include one or both of the magnetic assemblies 102, 112 to bias the flipper mullion 32 toward the first and/or second positions. In one embodiment, the spring 86 alone can be sufficient to operate movement of the flipper mullion as described herein. When the spring 86 is used in combination with either or both of the magnetic assemblies 102, 112, the biasing force of the spring 86 can be supplemented by the biasing forces of the magnetic assemblies 102, 112, thereby helping to form a stronger biasing force that biases and holds the flipper mullion 32 in the first or second position. Moreover, if the spring 86 or one of the magnetic assemblies 102, 112 fails, the biasing force of the non-failing device will still be available to help bias and hold the he flipper mullion 32 in the first or second position. Thus, it can be advantageous to use the spring 86 in combination with either or both of the magnetic assemblies 102, 112.

Structure for pivotally attaching the flipper mullion 32 to the hinge 48 will now be described. As shown in FIG. 3, the mullion assembly 30 can comprise a first connecting assembly 122 comprising a first projection 124 and a first receiving portion 126 that rotatably receives the first projection 124 to pivotally attach the flipper mullion 32 to the hinge 48. The first projection 124 can coupled to (e.g., integrally formed with) one of the flipper mullion 32 and the hinge 48. Meanwhile, the first receiving portion 126 can be coupled to (e.g., integrally formed with) the other of the flipper mullion 32 and the hinge 48. The first receiving portion 126 can comprise an aperture 128 that is coaxial with the axis X and circumferentially bounded about the axis X. In other words, the aperture 128 can be bounded completely about the axis X such that when the first projection 124 is received within the aperture 128, the first projection 124 is prevented from moving laterally outside of the bounded aperture 128 in any direction radial to the axis X.

The mullion assembly 30 can further comprise a second connecting assembly 130 comprising a second projection 134 and a second receiving portion 136 that rotatably receives the second projection 134 to pivotally attach the flipper mullion 32 to the hinge 48. The second projection 134 can be peg that is coupled to (e.g., integrally formed with) one of the flipper mullion 32 and the hinge 48. Meanwhile, the second receiving portion 136 can be coupled to (e.g., integrally formed with) the other of the flipper mullion 32 and the hinge 48. The second receiving portion 136 can comprise a pair of arms 138 that are configured to snappingly receive the second projection 134. More specifically, the arms 138 can define a channel 140 that is coaxial with the axis X. The channel 140 can be partially bounded about the axis X but partially open about some portion to permit the second projection 134 to be laterally received within the channel 140. Once received within the channel 140, the arms 138 can help hold the second projection 134 within the channel 140 but can also be deflected to permit lateral removal of the second projection 134 from the channel 140 in a direction that is radial to the axis X.

To pivotally attach the flipper mullion 32 to the hinge 48 using the first and second connecting assemblies 122, 130 described above, the first projection 124 can first be inserted into the aperture 128 of the first receiving portion 126. The second projection 134 can then be moved lateral to the axis X until the second projection 134 is snappingly received within the channel 140 defined by the arms 138 of the second receiving portion 136.

In some embodiments, the first connecting assembly 122 can be positioned below the snap-fitted second connecting assembly 130 along the axis X, as shown in FIG. 3. It can be advantageous to arrange the first connecting assembly 122 axially below the snap-fitted second connecting assembly 130 because the lower connecting assembly typically experiences greater loads than the upper connecting assembly and the first connecting assembly 122 can provide a stronger connection point than the snap-fitted second connecting assembly 130. However, in some embodiments, the first connecting assembly 122 can be positioned above the snap-fitted second connecting assembly 130 along the axis X.

In some examples, the flipper mullion 32 may comprise a resistive heater 144 that can be selectively energized to heat the flipper mullion 32 and inhibit the formation of condensation on the flipper mullion 32, as shown in FIG. 2. The resistive heater 144 preferably extends within the enclosure 44 of flipper mullion 32 and comprises an electrical coupling 146 for connecting the resistive heater 144 to a power source. As shown in FIG. 3, the electrical coupling 146 can extend through an opening 148 in the flipper mullion 32 near the hinge 48. Moreover, the hinge 48 includes an aperture 150 that can permit wiring from the left door 24 to pass therethrough and be connected to the electrical coupling 146 of the flipper mullion 32. The wiring within the left door 24 can electrically connect the resistive heater 144 to a power source that can be selectively operated to energize the resistive heater 144. By passing the wiring through the hinge 48, the amount of repetitive pivoting motion experienced by these elements can be reduced to thereby increase their operational life.

Although the mullion assembly 30 has been described above as having its flipper mullion 32 pivotally attached to the left door 24, it is to be appreciated that the mullion assembly 30 may be similarly configured in other embodiments such that its flipper mullion 32 is pivotally attached to the right door 26. Moreover, as discussed below, the mullion assembly 30 in some embodiments may be changeable between a first configuration wherein the flipper mullion 32 is pivotally attached to the left door 24 and a second configuration wherein the flipper mullion 32 is pivotally attached to the right door 26.

More specifically, in some examples, the flipper mullion 32 and the hinge 48 may both be removably attachable to each of the right and left doors 26, 28 to permit the mullion assembly 30 to be changeable between first and second configurations. In particular, the mullion assembly 30 may be assembled according to a first configuration wherein the flipper mullion 32 and the hinge 48 are removably attached to the left door 24 in a first orientation (as already described above). Alternatively, the mullion assembly 30 may be assembled according to a second configuration wherein the flipper mullion 32 and the hinge 48 are removably attached to the right door 26 in a second orientation that is upside-down relative to the first orientation, as shown in FIGS. 10-14.

The hinge 48 can be removably attached to the right door 26 using various means such as threads, fasteners, hooks, clips, or other means of removably attaching two separate parts. Preferably, the hinge 48 is removably attached to the right door 26 using the same means that are utilized to attach the hinge 48 to the left door 24 in the first configuration. For instance, the hinge 48 can be removably attached to each door 24, 26 using one or more threaded fasteners that pass through corresponding apertures (see e.g., aperture 152) in the hinge 48.

In the second configuration, the flipper mullion 32 can be removably attached to the hinge 48 using the first and second connecting assemblies 122, 130 described above. Moreover, wiring from the right door 26 can pass through the aperture 150 in the hinge 48 and be connected to the electrical coupling 146 of the flipper mullion's resistive heater 144. The wiring within the right door 26 can electrically connect the resistive heater 144 to its power source, which can be selectively operated to energize the resistive heater 144.

Figure 13:
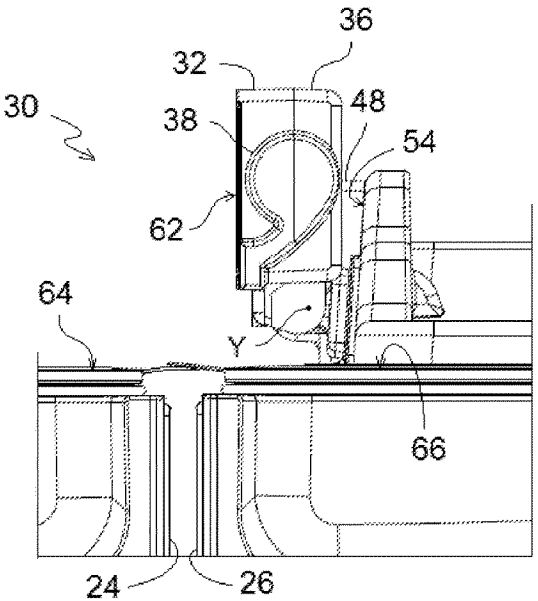
FIG. 13 is a view of the mullion assembly assembled according to the second configuration with the flipper mullion in a second position.
Figure 12:
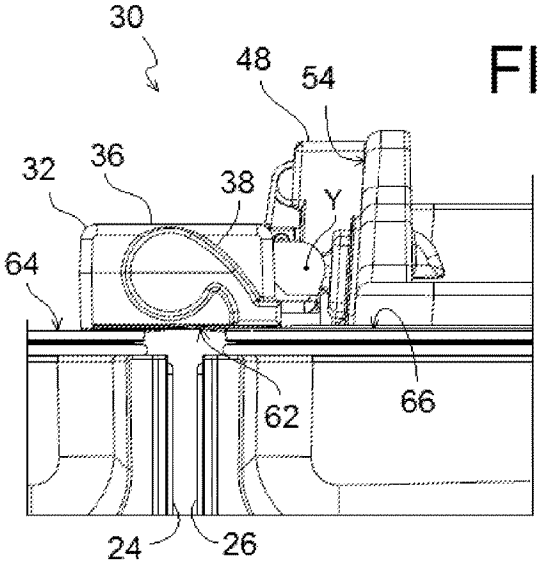
FIG. 12 is a view of the mullion assembly assembled according to the second configuration with the flipper mullion in a first position.
Figure 14:
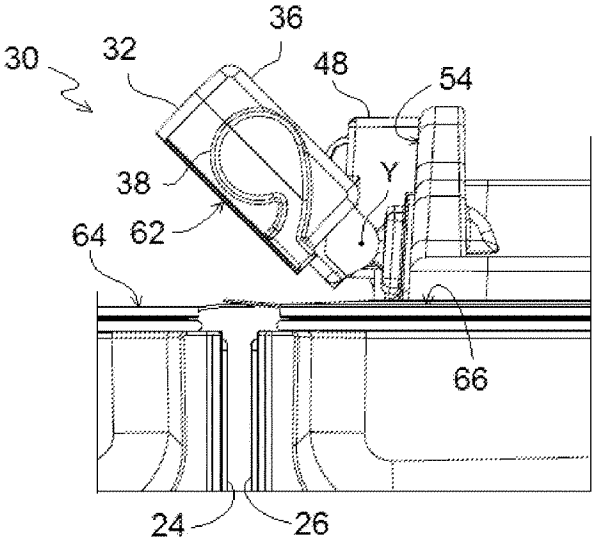
FIG. 14 is a view of the mullion assembly assembled according to the second configuration with the flipper mullion in an intermediate position.

When the mullion assembly 30 is assembled according to the second configuration, the flipper mullion 32 will be pivotally attached to the hinge 48 such that the flipper mullion 32 is rotatable relative to the hinge 48 about an axis Y. More specifically, the flipper mullion 32 will be rotatable between a first position (as shown in FIG. 12), a second position (as shown in FIG. 13), and an intermediate position that is intermediate the first and second positions (as shown in FIG. 14). When in the first position, the face 62 of the flipper mullion 32 will be substantially parallel to the rear surface 66 of the right door 26 and will preferably abut the rear surface 66 and/or any seal thereon. Moreover, when both doors 24, 26 are in the closed positon, the face 62 will also abut and be substantially parallel to the rear surface 64 of the left door 24 and/or any seal thereon. Accordingly, when both doors 24, 26 are in the closed positon and the flipper mullion 32 is in the first position, the flipper mullion 32 can provide a seal between the two doors 24, 26 that obstructs air from passing between the two doors 24, 26.

As can be seen in FIG. 12, when the flipper mullion 32 is in the first position and the left door 24 is closed, the left door 24 can obstruct opening and closing of the right door 26 due to the extension of the flipper mullion 32. Accordingly, the flipper mullion 32 can be rotated to the second position (shown in FIG. 13) to permit the right door 26 to be moved in or out of its closed position while the left door 24 remains in the closed position. More specifically, the flipper mullion 32 can be rotated approximately 90 degrees about the axis Y to the second position such that the face 62 of the flipper mullion 32 is substantially perpendicular to the rear surface 66 of the right door 26, though other angles are possible.

In the intermediate position, the face 62 of the flipper mullion 32 can be transverse to the rear surface 66 of the right door 26 at a continuum of angles somewhere between perpendicular and parallel of the rear surface 66 (e.g., 45 degrees).

Figure 10:
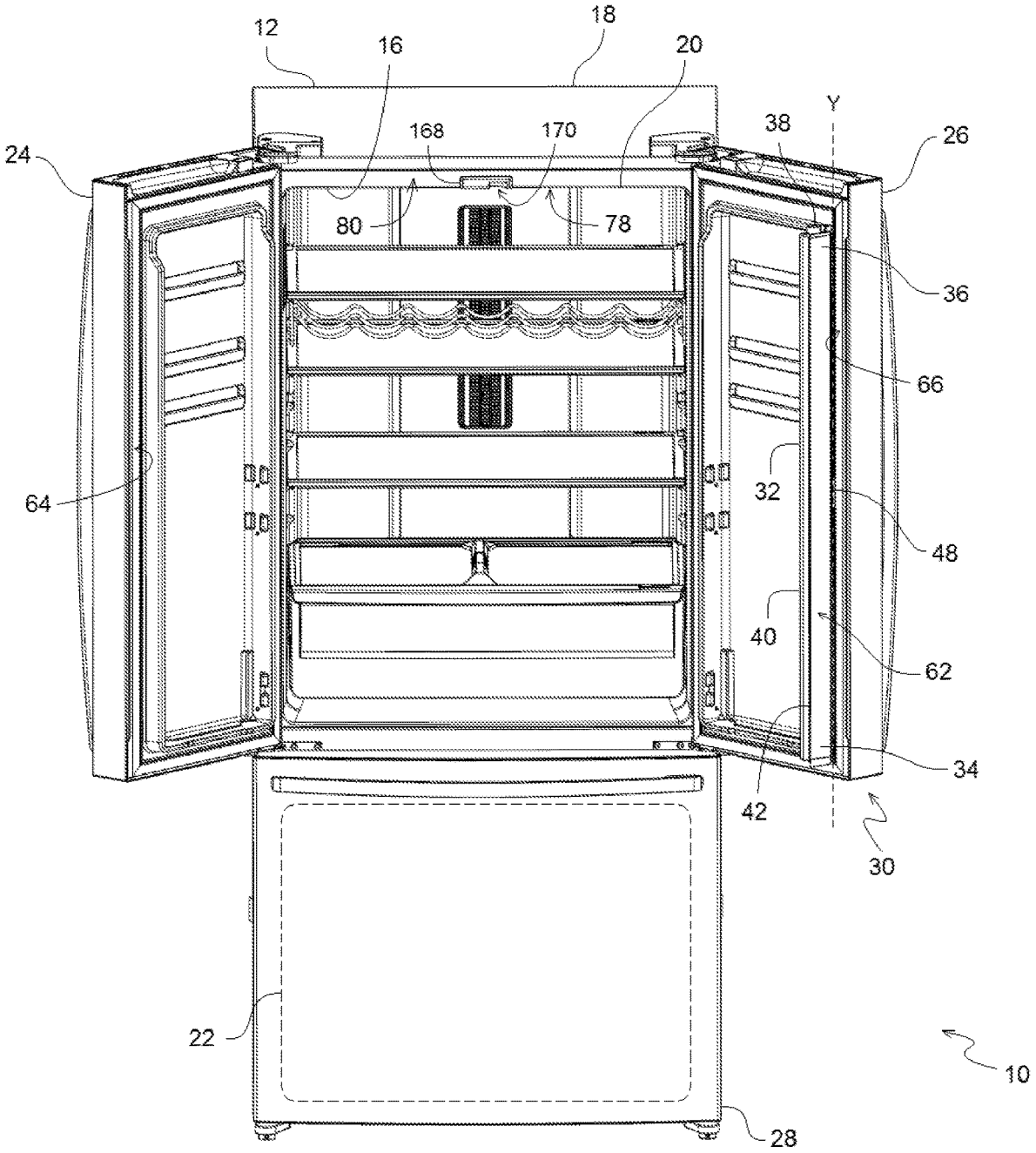
FIG. 10 is a front view of the example refrigerator assembly with the mullion assembly assembled according to a second configuration.
Figure 11:
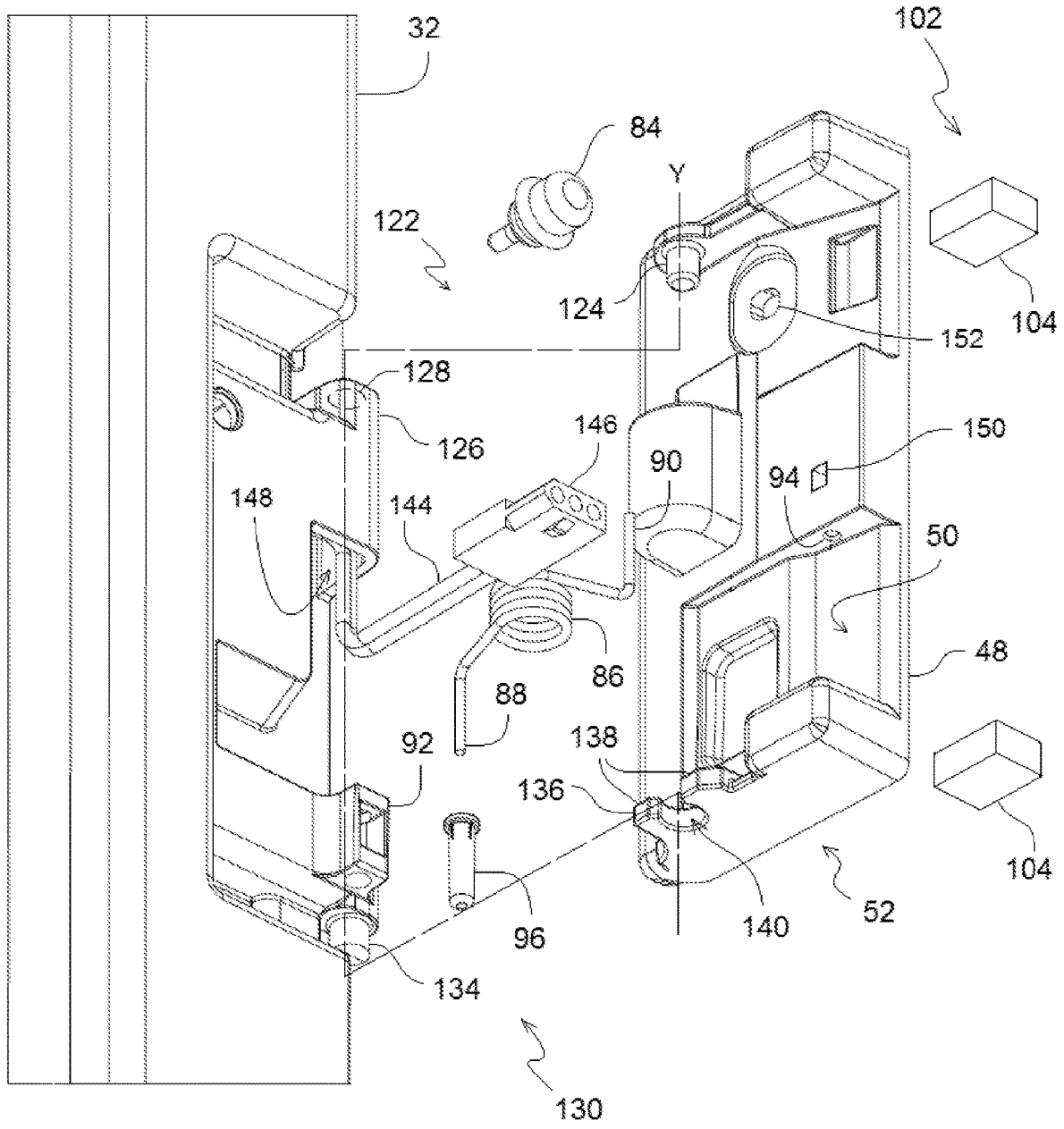
FIG. 11 is an exploded view of the mullion assembly with the flipper mullion and hinge arranged according to the second configuration.
Figure 15:
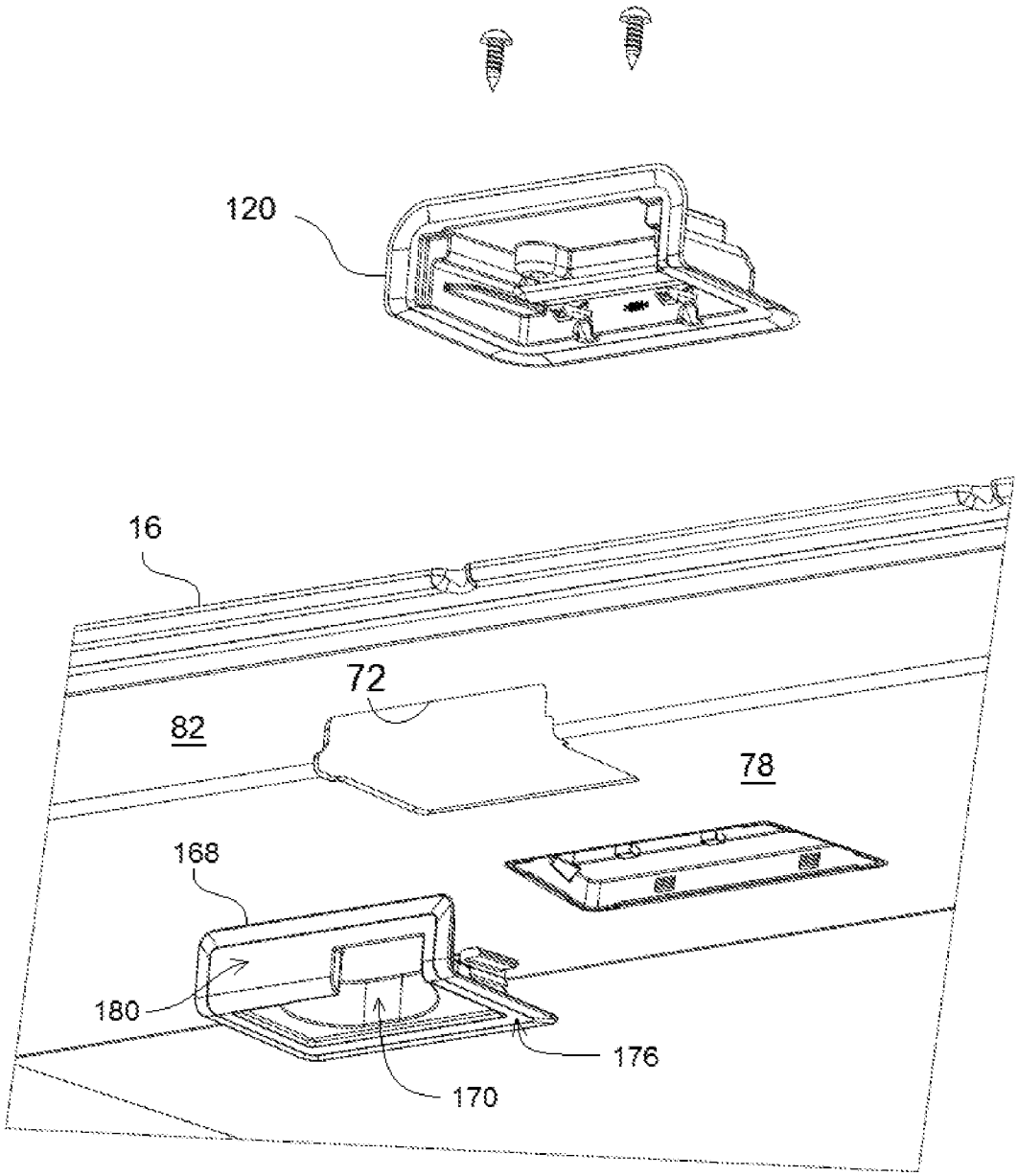
FIG. 15 is a partial exploded view of a second guide element and the compartment liner of the example refrigerator assembly.
Figure 16:
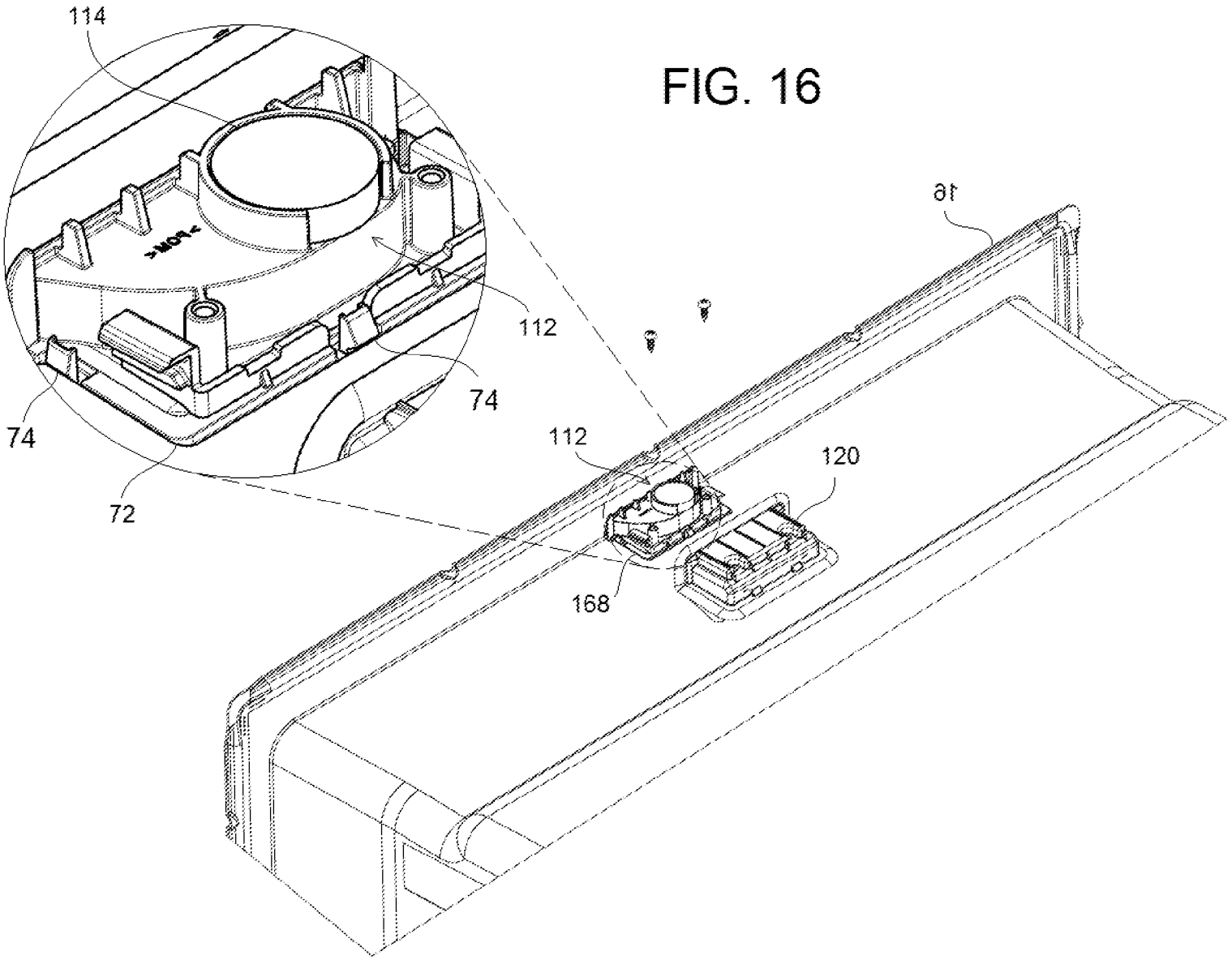
FIG. 16 is a perspective view of the second guide element coupled to the compartment liner.

As noted above, the flipper mullion 32 can include a mullion guide 38 at each end 34, 36 of the flipper mullion 32. Accordingly, in each of the first and second configurations, one of the mullion guides 38 will be located at the top of the flipper mullion 32 (as shown in FIGS. 1 & 10). Moreover, the mullion assembly 30 can include a second cabinet guide 168 to replace the cabinet guide 68 described above when the mullion assembly 30 is assembled according to the second configuration, as shown in FIGS. 15 & 16.

The second cabinet guide 168 includes a recess 170 that is configured to engage and guide the flipper mullion 32 when the mullion assembly 30 is assembled according to the second configuration. In particular, when the right door 26 is in the closed position, the mullion guide 38 at the end 36 of the flipper mullion 32 will be located within the recess 170 and the flipper mullion 32 will be aligned in its first position such that the face 62 of the flipper mullion 32 abuts and is substantially parallel to the rear surface 66 of the right door 26 and/or any seal thereon. As discussed above, in this position, the flipper mullion 32 can provide a seal between the doors 24, 26 when both doors 24, 26 are in the closed position. As the right door 26 is rotated from its closed position to its open position, the contours of the second cabinet guide 168 that define the recess 170 will engage and guide the mullion guide 38 of flipper mullion 32 such that the flipper mullion 32 rotates from its first position to its second position. Thus, the second cabinet guide 168 can guide the flipper mullion 32 to the second position to permit opening of the right door 26 while the left door 24 is closed. Once opened, the flipper mullion 32 can remain in the second position so that when the right door 26 is later rotated to its closed position, the left door 24 can remain in its closed position without obstructing closing of the right door 26. As the right door 26 is moved to its closed position, the mullion guide 38 of the flipper mullion 32 will engage the recess 170 of the second cabinet guide 168, which will guide the mullion guide 38 such that the flipper mullion 32 will rotate from the second position (or any position intermediate the first and second positions that the flipper mullion 32 may be in) back to the first position.

Like the first cabinet guide 68, the second cabinet guide 168 may be separately attached to the cabinet 12. For instance, in some examples, the second cabinet guide 168 can be inserted within the cutout portion 72 of the cabinet 12 and removably attached to the compartment liner 16 using the one or more latch members 74 located on the interior side of the compartment liner 16 (e.g., between the compartment liner 16 and the shell 18). Moreover, the second cabinet guide 168 can be preferably attached to the compartment liner 16 such that the second cabinet guide 168 is flush with the compartment liner 16. For example, a lower surface 176 of the second cabinet guide 168 can be flush with the upper, compartment surface 78 of the compartment liner 16 and a front surface 180 of the second cabinet guide 168 can be flush with the front, flange surface 82 of the compartment liner 16. Attaching the second cabinet guide 168 flush to the compartment liner 16 using internally located connecting structure can provide an aesthetically pleasing look. However, it is to be appreciated the second cabinet guide 168 in some examples may be attached to the cabinet 12 using externally visible connecting structure and/or may not be flush with the cabinet 12 in some examples.

When the mullion assembly 30 is assembled according to its second configuration, the bumper 84 (shown in FIG. 3) will be configured to inhibit movement of the flipper mullion 32 past its second position in a direction away from the first position. Furthermore, the spring 86 will 1) bias the flipper mullion 32 toward the first position when the flipper mullion 32 is between the first position and the intermediate position; and 2) bias the flipper mullion 32 toward the second position when the flipper mullion 32 is between the second position and the intermediate position. Still further, the magnetic assemblies 102, 112 will respectively bias the flipper mullion 32 toward its second and first positions.

In particular, the magnetic assembly 112 can include a magnetic cabinet body 114 coupled to an internal side of the second cabinet guide 168 (see e.g., FIG. 16) and a corresponding magnetic mullion body 116 provided within the mullion guide 38 at the end 36 of the flipper mullion 32 (see e.g., FIG. 2). The corresponding magnetic cabinet body 114 and magnetic mullion body 116 can thus engage with each other (i.e., magnetically couple) to bias the flipper mullion 32 towards its first position.

The mullion assembly 30 as described above can thus be alternated between a first configuration wherein the flipper mullion 32 is pivotally attached to the left door 24 and a second configuration wherein the flipper mullion 32 is pivotally attached to the right door 26. To alternate configurations, the flipper mullion 32 and hinge 48 can be removed from one door and then attached to the other door in a flipped orientation. Thus, the same flipper mullion 32 and hinge 48 can be utilized in each configuration, thereby eliminating the need to provide an alternative hinge or flipper mullion for each configuration. Moreover, depending on which door 24, 26 the flipper mullion 32 is attached to, either the first cabinet guide 68 or the second cabinet guide 168 can be removably attached to the cabinet 12 to assist in guiding the flipper mullion 32 between its first and second positions.

It is to be appreciated that in some examples, a hinge 48 may be provided for and attached (e.g., integral) to each door 24, 26 so that only the flipper mullion 32 needs to be removed and reattached to a different door to alternate the mullion assembly 30 between its first and second configurations. In such examples, the flipper mullion 32 will be pivotally attached to the hinge 48 on the left door 24 in the first configuration and the flipper mullion 32 will be pivotally attached to the hinge 48 on the right door 26 in the second configuration in an upside-down orientation.

Figure 17:
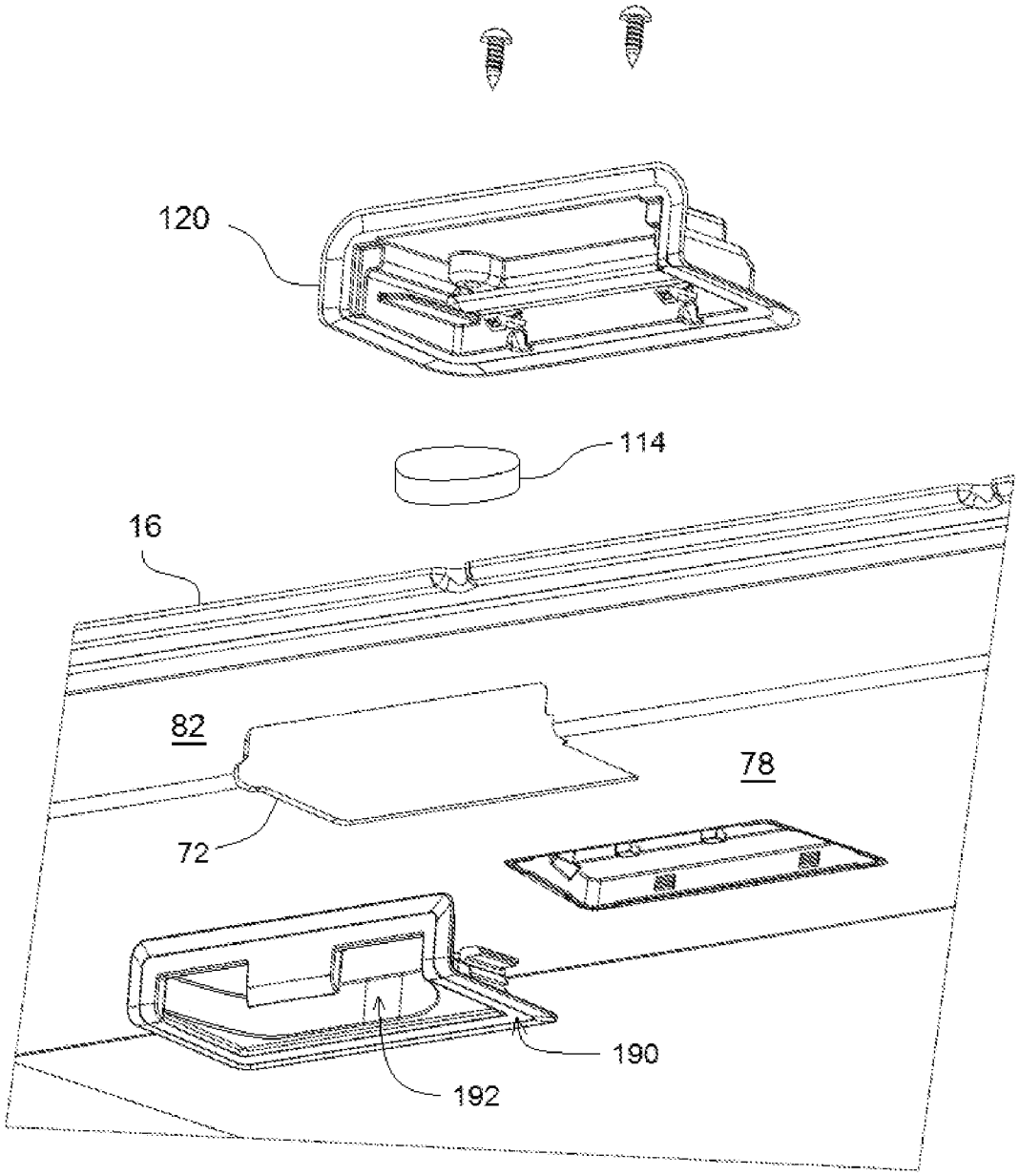
FIG. 17 is a partial exploded view of a third guide element and the compartment liner of the example refrigerator assembly.

Moreover, in some examples, the mullion assembly 30 can comprise a cabinet guide 190 (shown in FIG. 17) that includes a recess 192 configured to engage and guide the flipper mullion 32 in both configurations so that there is no need to replace the cabinet guide 190 with an alternative guide when changing configurations of the mullion assembly 30. Like the other cabinet guides 68, 168 described above, the cabinet guide 190 can be inserted within the cutout portion 72 of the cabinet 12 and removably attached to the compartment liner 16 using the one or more of the latch members 74 described above. Moreover, a magnetic cabinet body 114 can be arranged on the cabinet guide 190 so that 1) when the mullion assembly 30 is assembled according to the first configuration, the magnetic cabinet body 114 can magnetically couple with the magnetic mullion body 116 provided at the end 34 of the flipper mullion 32 to bias the flipper mullion 32 towards its first position; and 2) when the mullion assembly 30 is assembled according to the second configuration, the magnetic cabinet body 114 can magnetically couple with the magnetic mullion body 116 provided at the other end 36 of the flipper mullion 32 to bias the flipper mullion 32 towards its first position.

Figure 18:
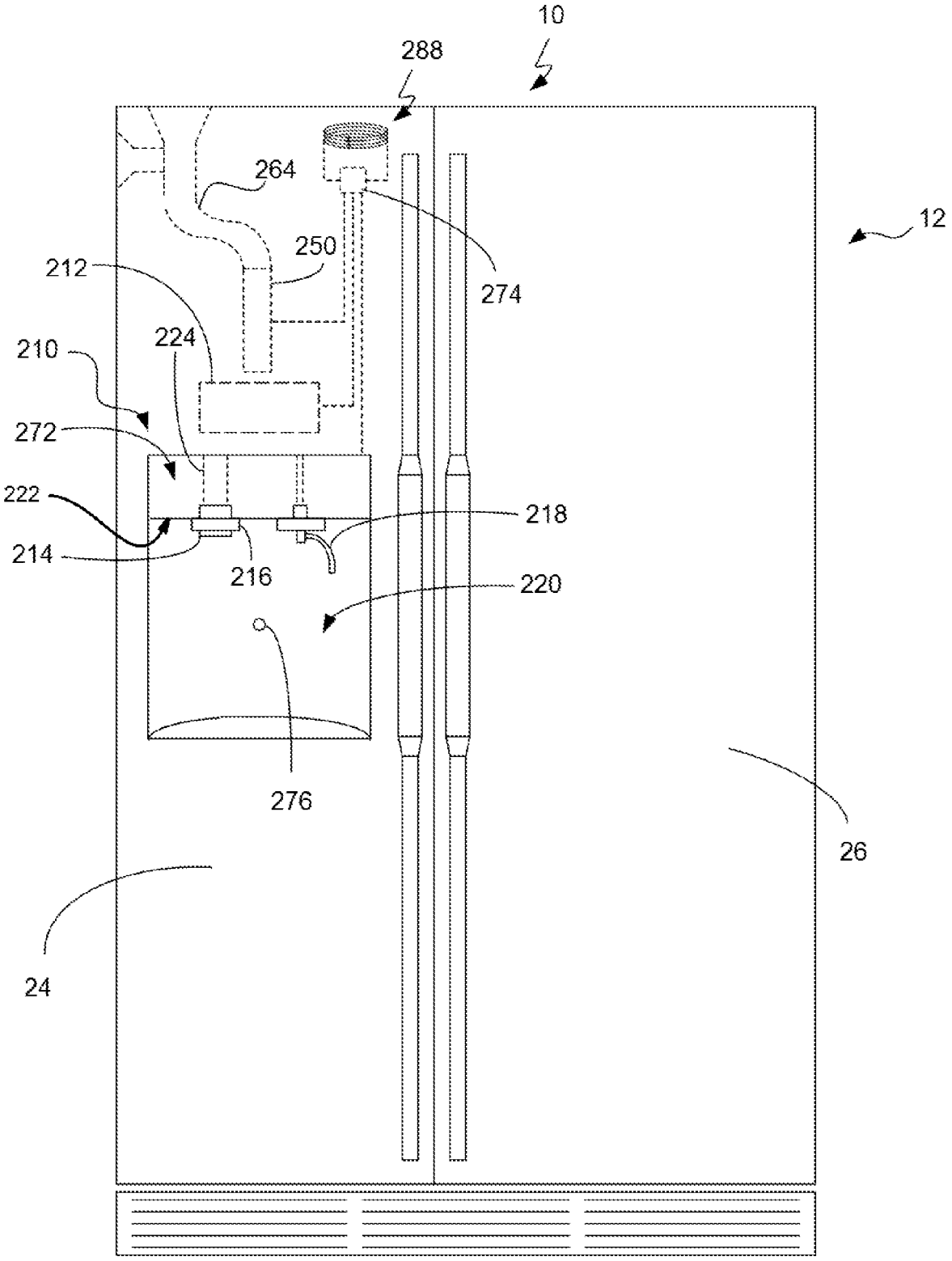
FIG. 18 is a front view of the example refrigerator assembly with a dispenser assembly.

Turning now to FIG. 18, the refrigerator assembly 10 in some examples can comprise a dispenser assembly 210 for dispensing cold water, hot water, ice, or some combination thereof. The dispenser assembly 210 can correspond to any of the dispensers described in U.S. Pat. Nos. 8,967,432 and 9,139,415, which are herein incorporated by reference in their entireties. Although the dispenser assembly 210 is shown and described below as being located on the left door 24, it is to be appreciated that the dispenser assembly 210 may be located on any other door of the refrigerator assembly 10. Preferably, the dispenser assembly is located on an exterior surface of either or both of the refrigerator door(s). Additionally, although shown in a side-by-side refrigerator, it is understood that the induction technology described herein can be used in other types of refrigerators or freezers, including French door bottom mount refrigerators, top mount refrigerators, single-compartment refrigerators/freezers, or even in other appliances.

The dispenser assembly 210 can comprise a cold water outlet 214 for dispensing cold water, an ice outlet 216 for dispensing ice, a hot water outlet 218 for dispensing hot water, or some combination thereof. The cold water outlet 214, ice outlet 216, and hot water outlet 218 can each be coupled (e.g., fixed) to the door 24 such that each outlet is movable with the door 24 relative to the cabinet 12. In particular, the cold water outlet 214, ice outlet 216, and hot water outlet 218 can each be provided in a recess 220 of the door 24 at an upper surface 222 of the recess 220. In the illustrated embodiment, the outlets 214, 216, 218 are all separate outlets. Moreover, the cold water outlet 214 and ice outlet 216 are concentrically arranged while the hot water outlet 218 is axially spaced from the cold water outlet 214 and ice outlet 216. However, other configurations are possible in other embodiments. Indeed, in some examples, two or more of the outlets 214, 216, 218 may be the same outlet.

The dispenser assembly 210 can include one or more supply systems that are configured to selectively supply water or ice to one or more of the outlets 214, 216, 218. For instance, the dispenser assembly 210 can include an ice source 212 that is arranged in communication with the ice outlet 216 for supplying ice to the ice outlet 216. The ice source 212 may located within a compartment of the cabinet 12, a door of the refrigerator assembly 10, or some other portion of the refrigerator assembly 10. Ice can be delivered from the ice source 212 to the ice outlet 216 by an auger that, upon activation, rotates so as to drive the ice from the ice source 212 to the ice outlet 216.

Figure 19:
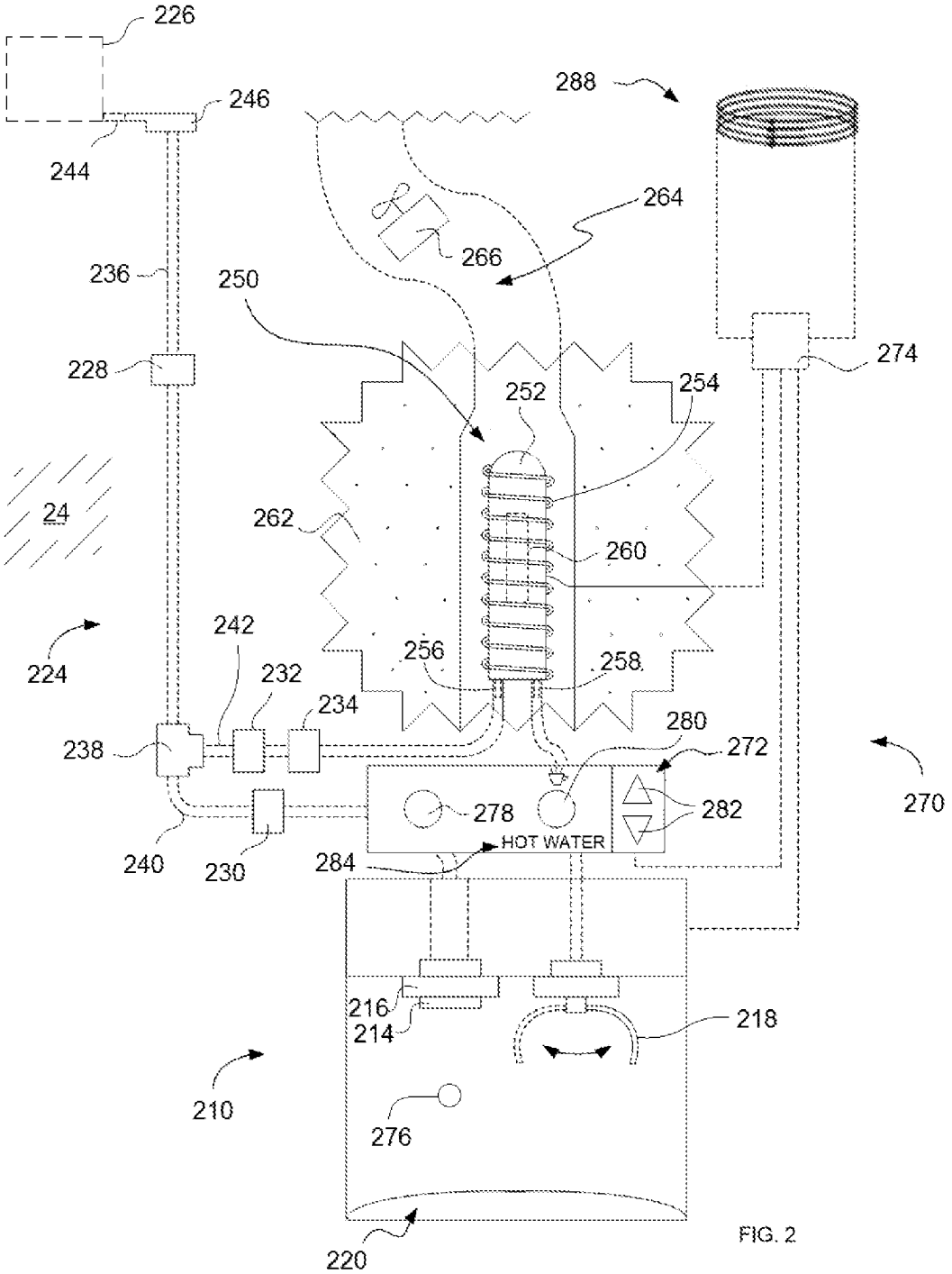
FIG. 19 is a schematic, partial cross-sectional view of the dispenser assembly.

As another example, the dispenser assembly 210 can include at least one water line 224 that fluidly couples the cold water outlet 214 and/or the hot water outlet 218 to a water source 226, as shown in FIG. 19. The water source 226 can be, for example, a household water supply, a water reservoir within the refrigerator cabinet 12, or any other source of water that can supply water to the water line 224. At least one water filter 228 may be provided in fluid communication with the water line 224 to purify incoming water. Furthermore, the dispenser assembly 210 can includes one or more valves 230, 232 (e.g., solenoid or motor operated) in fluid communication with the water line 224 that can be selectively opened and closed to regulate flow through the water line 224 to the cold water outlet 214 and/or the hot water outlet 218. The dispenser assembly 210 can also include one or more flow meters 234 that are configured to measure the flow of water through the water line 224 and provide an output (e.g., visual indicia, voltage or other control signal, etc.) that indicates the measured flow.

In the present example, the water line 224 includes an inlet portion 236 that feeds into a manifold 238. The manifold 238 fluidly couples the inlet portion 236 to a cold water portion 240 and a hot water portion 242. The cold water portion 240 is fluidly coupled downstream to the cold water outlet 214 and the hot water portion 242 is fluidly coupled downstream to the hot water outlet 218. One valve 230 can be selectively opened and closed to regulate flow through the cold water portion 240, while the other valve 232 can be selectively opened and closed to regulate flow through the hot water portion 242. Moreover, a flow meter 234 is configured to measure the flow of water through the hot water portion 242 and provide an output (e.g., visual indicia, voltage or other control signal, etc.) that indicates the measured flow. The water filter 228 can be located along the inlet portion 236 of the water line 224 such that as water is fed through the inlet portion 236 to the cold water portion 240 and/or hot water portion 242, the water filter 228 can purify the water. However, it is to be appreciated that the water line 224 can have other configurations without departing from the scope of the invention.

The water line 224 can be arranged such that an inlet 244 of the water line 224 is located external of the door 24 (e.g., adjacent the water source 226 within the cabinet 12) and the water line 224 extends from the inlet 244 into the door 24. In some examples, the water line 224 can comprise a flexible hose portion that enters the door 24 through an aperture and is of sufficient length and flexibility to accommodate the pivoting action of the door 24 as it is selectively opened and closed. Moreover, in some examples, the water line 224 can extend through a hollow hinge 246 that pivotally attaches the door 24 to the cabinet 12. In particular, the hollow hinge 246 can include a hollow hinge pin or the like, and the water line 224 can pass through the hollow hinge 246 into the door 24.

Preferably, the dispenser assembly 210 is configured to dispense hot water through the hot water outlet 218 "instantly", meaning on-demand in a relatively short amount of time without having to maintain a reservoir of hot water. In some examples, the dispenser assembly 10 can include a water heater 250 that is configured to heat water that flows through the water line 224 to the hot water outlet 218. The water heater 250 can be disposed within an interior of the door 24, as shown in FIG. 19. Alternatively, the water heater 250 can be mounted on an exterior surface of the refrigerator assembly 10 or disposed within some other portion of the refrigerator assembly 10.

The water heater 250 can include a heating element 252 and a heating conduit 254 that is located adjacent to the heating element 252. The heating element 252 is in one example a cartridge-style heater that is tube-shaped and generates heat through the application of electric power thereto in order to heat water within the adjacent heating conduit 254. The heating conduit 254 can be made of various materials having a relatively high thermal conductivity (e.g., metal, such as aluminum, copper, steel, etc.) and can correspond to a portion of the water line 224 (e.g., hot water portion 242) or a separate element that is fluidly coupled between the water line 224 and the hot water outlet 218. Preferably, the heating conduit 254 comprises one or more loops that extend about and contact the heating element 252. However, it is to be appreciated that the heating element 252 and/or heating conduit 254 can comprise other configurations in other examples. For instance, the heating element 252 may comprise other non-cylindrical shapes in some examples. Moreover, the heating conduit 254 may be slightly spaced from the heating element 252 and in some examples, may not loop around the heating element 252. Indeed, it is contemplated that the heating element 252 can follow along or even wrap about the heating conduit 254. The heating conduit 254 may even feed water into/through the heating element 252. The heating element 252 and/or heating conduit 254 can comprise a variety of different configurations wherein the heating element 252 can be energized through the application of electric power in order to heat water within the heating conduit 254.

Water from the water source 226 can enter the heating conduit 254 via an inlet 256. The valve 232 can be selectively opened and closed to regulate flow through heating conduit 254. The heating element 252 can be energized to produce heat such that as water flows through or resides in the heating conduit 254, the water can be heated by the heating element 252. The water will then exit the heating conduit 254 via an outlet 258, which is fluidly coupled to the hot water outlet 218.

In some examples, the water heater 250 can include a temperature sensor 260 that is configured to measure the temperature of the water within the heating conduit 254 or the temperature of some other element (e.g., the heating conduit 254 itself or the heating element 252) that is indicative of the water temperature. The temperature sensor 260 can be configured to provide an output (e.g., visual indicia, voltage or other control signal, temperature value, etc.) that indicates its measured temperature. Based on the measured temperature, the heating element 252 and/or valve 232 can be selectively operated to regulate (e.g., adjust or maintain) the temperature of the water that exits the hot water outlet 218. For instance, if the measured temperature is below a desired level, the heating element 252 can be energized and/or the water flow through the heating conduit 254 can be reduced (e.g., stopped) until the measured temperature reaches the desired level. Conversely, if the measured temperature is above a desired temperature, the heating element 252 can be de-energized and/or the water flow through the heating conduit 254 can be increased until the measured temperature reaches the desired level.

An insulated shielding layer (e.g., insulating foam 262) can be positioned between the water heater 250 and front and/or rear sides of the door 24 to inhibit undesired heat from entering into the refrigerated compartment, or radiating outwards towards the user. In addition or alternatively, the dispenser assembly 210 can optionally include an exhaust duct 264 that extends through the door 24 and is in communication with the atmosphere external to the refrigerator 10. The exhaust duct 264 can be at least partially formed within the door 24 by the foam insulation 262. In some examples, the exhaust duct 264 can be a shell that is secured in place by mechanical fasteners, adhesives, or the foam insulation 262. The heating element 252 can be arranged at least partially within the exhaust duct 264 such that heat generated by the heating element 252 can escape through the exhaust duct 264 to the exterior environment. Moreover, the door 24 preferably includes an access panel (not shown) that can be opened to provide access within the exhaust duct 264 so that the heating element 252 can be removed to facilitate service.

In some examples, the dispenser assembly 210 can optionally include a fan 266 that can be selectively operated to move (e.g., draw or push) air through the exhaust duct 264 past the heating element 252. The fan 266 can be arranged within the exhaust duct 264 or located in some region external to the exhaust duct 264 that is in fluid communication with the interior of the exhaust duct 264. The fan 266 can be operable to facilitate the dissipation of heat from the heating element 252 through the exhaust duct 264. In addition or alternatively, the fan 266 can be operable to regulate (e.g., adjust or maintain) the temperature of the water that exits the hot water outlet 218. For instance, if the temperature measured by the temperature sensor 260 is above a desired level, a speed of the fan 266 can be increased to cool the water within the heating conduit 254 until the measured temperature reaches the desired level. Conversely, if the measured temperature is below a desired temperature, the fan speed can be reduced (e.g., stopped) until the measured temperature reaches the desired level.

The dispenser assembly 210 can further include a control system 270 for controlling one or more of the devices described above (e.g., ice auger, valve 230, valve 232, flow meter 234, heating element 252, temperature sensor 260, fan 266, etc.). The control system 270 can include a user interface 272 and a controller 274 (e.g., microprocessor) that is in communication with the user interface 272 and one or more of the devices. The user interface 272 is preferably provided on an outer surface of the door 24 near the recess 220. Moreover, the controller 274 can be provided within the door 24. However, the user interface 272 and/or controller 274 may be provided in other locations in other examples. For instance, the user interface 272 may be provided on the other door 26 or the refrigerator cabinet 12. Moreover, the controller 274 may be located on or within the refrigerator cabinet 12.

The user interface 272 can permit a user to selectively operate the one or more devices according to any of their operations described above via the controller 274. For instance, the user interface 272 can include an ice activation switch 276 that can be engaged (e.g., pressed) to dispense ice. In response to engagement of the ice activation switch 276, the controller 274 can operate the ice auger to dispense ice from the ice outlet 216. The controller 274 can continue to operate the ice auger until the ice activation switch 276 is no longer engaged.

As another example, the user interface 272 can include a cold water activation switch 278 that can be engaged (e.g., pressed) to dispense cold water. In response to engagement of the cold water activation switch 278, the controller 274 can open the valve 230 to generate flow through cold water portion 240 of the water line 224 and dispense cold water from the cold water outlet 214. The controller 274 can maintain the valve 230 in an open state until the cold water activation switch 278 is no longer engaged, at which point the controller 274 will close the valve 230.

As yet another example, the user interface 272 can include a hot water activation switch 280 that can be engaged (e.g., pressed) to dispense hot water. Moreover, the user interface 272 can include a temperature control 282 that can permit a user to enter a desired temperature for the hot water to be dispensed. In response to engagement of the hot water activation switch 280, the controller 274 can control the valve 232, heating element 252, and/or fan 266 to generate flow through hot water portion 242 of the water line 224 and dispense hot water from the hot water outlet 218 at the desired temperature set by the temperature control 282. In particular, based on the temperature measured by temperature sensor 260 and the flow measured by the flow meter 234, the controller 274 can vary the operation of the valve 232, heating element 252, and/or fan 266 such that the water dispensed from the hot water outlet 218 is at the desired temperature. For instance, if the temperature measured by the temperature sensor 260 is below the desired level, the controller 274 can energize the heating element 252, reduce flow through the heating conduit 254, reduce the speed of the fan 266, or some combination thereof until the measured temperature reaches the desired level. Conversely, if the temperature measured by the temperature sensor 260 is above the desired level, the controller 274 can de-energize the heating element 252, increase flow through the heating conduit 254, increase the speed of the fan 266, or some combination thereof until the measured temperature reaches the desired level. An alert (e.g., sound, visual indicia 284) can be provided to indicate whether hot water is actively being dispensed by the dispenser assembly 210. The controller 274 can continue to generate flow through the heating conduit 254 to the hot water outlet 218 until the hot water activation switch 280 is no longer engaged, at which point the controller 274 will close the valve 232.

Figure 20A:
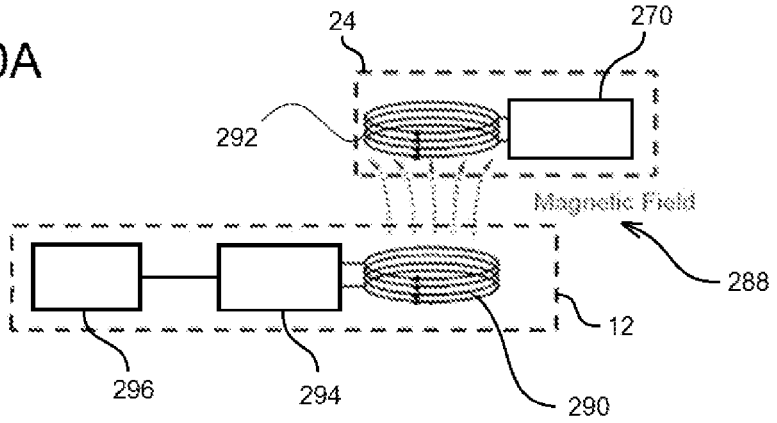
FIG. 20A is a schematic view of an induction assembly of the dispenser assembly according to a first embodiment.
Figure 20B:
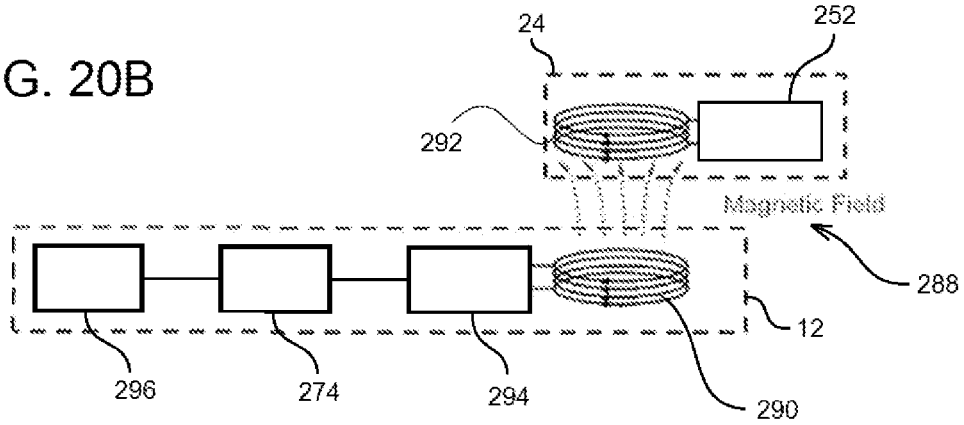
FIG. 20B is a schematic view of the induction assembly of the dispenser assembly according to a second embodiment.
Figure 20C:
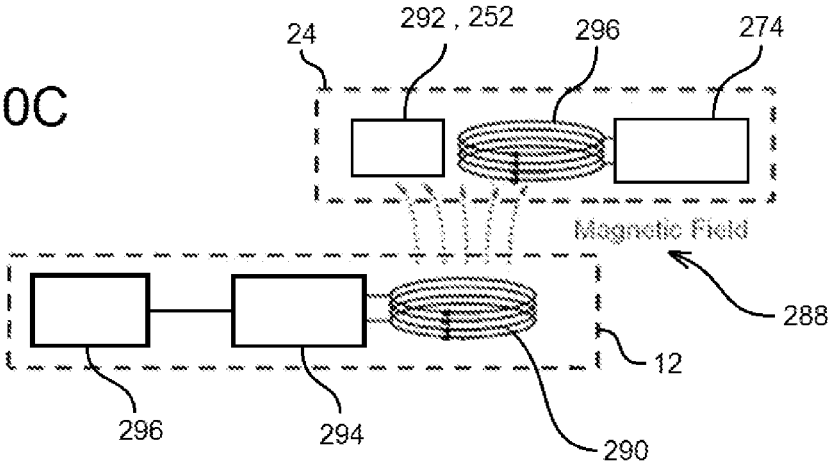
FIG. 20C is a schematic view of the induction assembly of the dispenser assembly according to a third embodiment.

Turning to FIGS. 20A-20C, the refrigerator assembly 10 can include an induction assembly 288 that is configured to induce a current to provide communication and/or power to one or more devices of the refrigerator door, such as the dispenser assembly 210 (e.g., the ice auger, valve 230, valve 232, flow meter 234, heating element 252, temperature sensor 260, fan 266, control system 270, etc.), user interface controls, other control systems, displays, lights, sensors, power supplies, communication systems, or any other electrically operated elements on, in, or supported by, the door. In particular, the induction assembly 288 can include a first induction element 290 provided on (e.g., within) the cabinet 12 and a second induction element 292 provided on (e.g., within) the door 24, as shown in FIG. 20A. In particular, the first induction element 290 can be coupled (e.g., fixed) to the cabinet 12 and the second induction element 292 can be coupled (e.g., fixed) to the door 24 such that the second induction element 292 and door 24 are movable with respect to the cabinet 12 and first induction element 290. As will be discussed further below, the induction assembly 288 can be configured to generate an electrical inductive coupling between the first and second induction elements 290, 292 that will induce a current in to thereby power one or more devices in the door, such as one or more devices of the dispenser assembly 210 to transfer power and/or communication to/from the device(s) of the dispenser assembly 210. In this manner, power and/or communication may be transferred to/from the device(s) without the need to run wiring from the cabinet 12 to the door 24. Preferably, the inductive coupling between the first and second induction elements 290, 292 will enable digital communication therebetween (and by extension communication between a first device in the cabinet and a second device in the door), although analog communication is also contemplated. For brevity, the following discussion will describe use of the first and second induction elements 290, 292 to power the dispenser assembly 210 of the door. However, it is contemplated that the first and second induction elements 290, 292 can, in addition or alternatively, provide power and/or data communication with various other devices, such as user interface controls, other control systems, displays, lights, sensors, communication systems, power supplies, or any other electrically operated elements on, in, or supported by, the door, and that the disclosure herein is intended to cover all such uses.

More specifically, as shown in in FIG. 20A, the first induction element 290 can correspond to a transmission coil and the second induction element 292 can correspond to a pickup coil. The induction assembly 288 can comprise an induction generator 294 provided on (e.g., fixed to) the cabinet 12 that is electrically connected to a power source 296 and the first induction element 290. The second induction element 292 can be electrically connected to one or more devices (e.g., ice auger, valve 230, valve 232, flow meter 234, heating element 252, temperature sensor 260, fan 266, control system 270, etc.) of the dispenser assembly 210. The induction generator 294 can be selectively operated to provide an excitation current to the first induction element 290, which in turn will generate a magnetic flux. The second induction element 292 can be arranged on the door 24 in close proximity to the first induction element 290 such that the second induction element 292 is within the magnetic flux created by the first induction element 290, thereby forming an electrical inductive coupling between the first and second induction elements 290, 292. Preferably, the first and second induction elements 290, 292 are arranged near the door's axis of rotation so that the induction elements 290, 292 can remain in close proximity to each other as the door 24 is rotated open, thereby ensuring that the second induction element 292 remains within the magnetic flux of the first induction element 290 when the door 24 is open. In one example, the induction element 292 within the door 24 can be exposed to one or more surfaces of the door 24, such as an interior face surface and/or a side edge of the door. In one embodiment, the induction element 292 within the door 24 could be located within a corner edge of the door 24. In an alternative embodiment, the induction element 292 within the door 24 could be exposed to only one of the interior face surface and/or a side edge of the door 24. As the magnetic flux is generated by the induction generator 294, the magnetic flux will induce a current in the second induction element 292 and the device(s) electrically connected to the second induction element 292. In this manner, power and/or communication may be transferred to the device(s) of the dispenser assembly 210 connected to the second induction element 292 via the inductive coupling of the first and second induction elements 290, 292. Optionally, because power supply and/or communication between the cabinet and door may be occasionally interrupted, it is further contemplated that an auxiliary power supply can be provided to the door to provide backup and/or supplemental power to the devices when the main induction power supply is interrupted. Various examples of the auxiliary power supply can include batteries, super-capacitors, solar cells, or the like. In one embodiment, the auxiliary power supply can be rechargeable by the current of the first and second induction elements 290, 292, and can automatically power the devices when power supply and/or communication between the cabinet and door is interrupted.

In some examples, the controller 274 of the dispenser assembly 210 can be located on the refrigerator cabinet 12 and can be electrically connected to the induction generator 294, as shown in FIG. 20B. In such examples, the controller 274 can selectively operate the induction generator 294 to provide an excitation current to the first induction element 290. Meanwhile, the second induction element 292 can be electrically connected to one or more other devices (e.g., ice auger, valve 230, valve 232, flow meter 234, heating element 252, temperature sensor 260, fan 266, user interface 272, etc.) of the dispenser assembly 210. Thus, as the magnetic flux is generated by the induction generator 294 via the controller 274, the magnetic flux will induce a current in the second induction element 292 and the device(s) coupled thereto. In this manner, power and/or communication may be transferred from the controller 272 to the other device(s) of the dispenser assembly 210 via the inductive coupling of the first and second induction elements 290, 292. In particular, the controller 272 can selectively operate the induction generator 294 to transfer power and/or communication to the other device(s) of the dispenser assembly 210 so as to perform any of the operations described above.

In some examples, the second induction element 292 can be a ferrous element that corresponds to the heating element 252 of the water heater 250 (or a portion thereof), as shown in FIG. 20C. Thus, as the magnetic flux is generated by the induction generator 294, the magnetic flux will induce a current in the heating element 252 of the dispenser assembly 210 that generates heat for transfer to the water within the heating conduit 254.

Figure 20D:
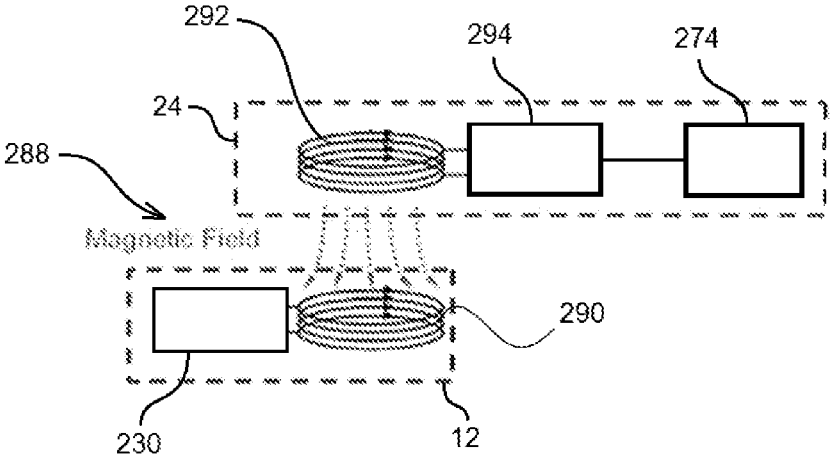
FIG. 20D is a schematic view of the induction assembly of the dispenser assembly according to a fourth embodiment.

Still further in some examples, the induction generator 294 may be provided on the door 24, as shown in FIG. 20D. In such examples, the first induction element 290 can correspond to a pickup coil and the second induction element 292 can correspond to a transmission coil. Moreover, the first induction element 290 can be electrically connected to one or more devices (e.g., ice auger, valve 230, valve 232, flow meter 234, etc.) of the dispenser assembly 210. The induction generator 294 can be selectively operated (e.g., via the controller 274) to provide an excitation current to the second induction element 292, which in turn will generate a magnetic flux. The first induction element 290 can be arranged on the cabinet 12 in close proximity to the second induction element 292 such that the first induction element 290 is within the magnetic flux created by the second induction element 292, thereby forming an inductive coupling between the first and second induction elements 290, 292. Preferably, the first and second induction elements 290, 292 are arranged near or along the door's axis of rotation so that the induction elements 290, 292 can remain in close proximity to each other as the door 24 is rotated open, thereby ensuring that the first induction element 290 remains within the magnetic flux of the second induction element 292 when the door 24 is open. As the magnetic flux is generated by the induction generator 294, the magnetic flux will induce a current in the first induction element 290 and the device(s) electrically connected to the first induction element 290. In this manner, power and/or communication may be transferred to the device(s) of the dispenser assembly 210 connected to the first induction element 290 via the inductive coupling of the first and second induction elements 290, 292.

The induction assembly 288 can comprise any configuration of induction elements that can be inductively coupled to induce a current within one or more devices of the dispenser assembly 210. Moreover, although the induction assembly 288 described above provides an inductive coupling between the cabinet 12 and door 24, it is to be appreciated that the induction assembly 288 in other examples may be similarly configured to provide an inductive coupling between the cabinet 12 and any other door of the refrigerator assembly.

In still a further embodiment, the induction assembly 288 can be used to detect a position of the refrigerator door, and may further be used to replace a conventional door switch (i.e., a binary contact or push-to-close switch). Where the first induction element 290 is positioned in the cabinet and the second induction element 292 is positioned on the door 24 in close proximity to the first induction element 290, pivoting motion of the door (i.e., opening and closing) will typically operate to move the first and second induction elements 290, 292 relatively closer or farther to each other. The relative distance between the first and second induction elements 290, 292 will change the efficiency of power transfer therebetween; less distance will increase the efficiency and more distance will decrease the efficiency. For example, when the refrigerator door is fully closed and the first and second induction elements 290, 292 are arranged at the closest position (i.e., least separation distance), about 80-90%+ of the power input to the first induction element 290 will be transmitted to the second induction element 292. However, as the door is opened, the amount of power transmitted to the second induction element 292 will decrease as a function of separation distance (which is driven by the pivoting angle of the door as it is opened). As the door is half open, the efficiency of power transfer may drop to less than 50%, and as the door continues to be pivoted open the efficiency will continue to decrease (i.e., 40%, 30%, 20%, etc.). In one embodiment, the first and second induction elements 290, 292 are arranged so that there is always some minimum amount of power transfer therebetween. In another embodiment, the first and second induction elements 290, 292 are arranged so that there the amount of power transfer therebetween is zero, or approaches zero. Of course, although power transfer efficiency is one measure, it is contemplated that input and/or output voltage and/or current can also be used.

The control system of the refrigerator can utilize the detected efficiency of the power transfer between the first and second induction elements 290, 292 (or input and/or output voltage and/or current) to determine whether the refrigerator door is open or closed. For example, the control system of the refrigerator can be programmed to look for a decreased (or decreasing, or zero) power transfer efficiency and can interpret that occurrence as a door-open condition. Conversely, an increased or increasing power transfer efficiency can be interpreted as a door-closed condition. It is understood that the determination of a door open or closed condition can be made on the basis of a changing power transfer efficiency (or input and/or output voltage and/or current), or on the basis of predetermined threshold values. Additionally, the induction generator 294 can determine the power transfer efficiency by comparing how much input power is being utilized by the first induction element 290 as compared with how much power is being accepted/used by the second induction element 292. The control system of the refrigerator can use this information from the induction generator 294 as an input to determine the door open/close state. Alternatively, communication from a device within the door can tell the control system of the refrigerator whether and/or the amount of power received by the door device(s) to determine the door open/close state.

Figure 21:
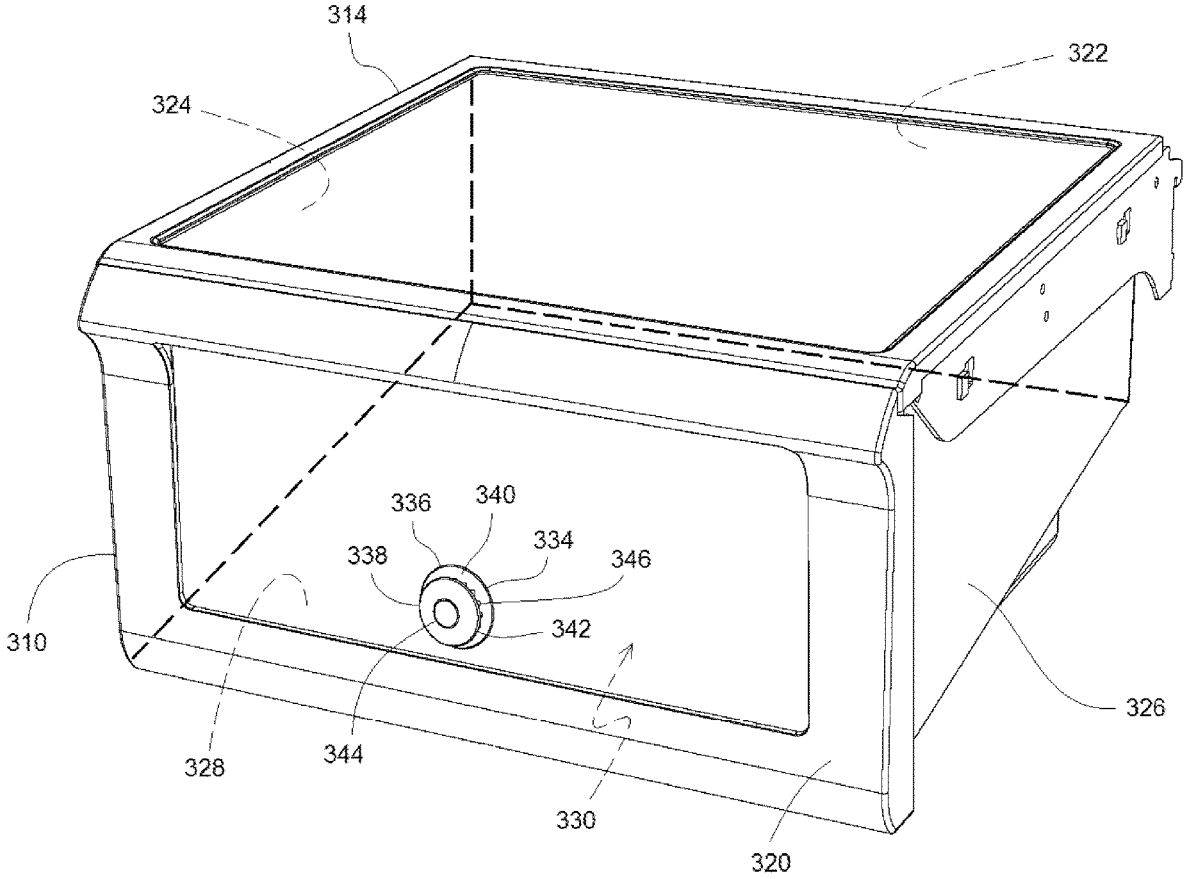
FIG. 21 is a perspective view of a container of the example refrigerator assembly with a ventilation button.

Turning to FIG. 21, in some examples the refrigerator assembly 10 can include a container 310 within a storage compartment (e.g., the first storage compartment 20 and second storage compartment 22 described above) of the refrigerator assembly 10. The container 310 can be slidably mounted within the compartment such that the container can slide between a closed position and an open position. For example, the container 310 can be suspended from a shelf 314 via rails provided on an underside of the shelf 314. Alternatively, the container 310 can be supported by rails provided on side walls of the storage compartment. In some examples, the container 310 may be fixed within the storage compartment such that the container 310 does not slide relative to the storage compartment. The container 310 can be mounted within the storage compartment in a variety of manners without departing from the scope of the invention.

The container 310 may be box-like in shape and can include a front wall 320, a rear wall 322, a left side wall 324, a right side wall 326, and a bottom wall 328 that together define an enclosure 330 for storing food items. When the container 310 is in its closed position, the shelf 314 above the container 310 can cover the enclosure 330, thereby inhibiting access to the enclosure 330. Moreover, when the container 310 is in its open position, the enclosure 330 may be exposed and accessible from above the enclosure 330. However, it is to be appreciated that the container 310 can comprise a variety of different shapes and configurations that include one or more walls defining an enclosure for storing food items.

The container 310 can include a ventilation button 334 on one of its walls (e.g., front wall 320) that can provide ventilation of the enclosure 330 with the atmosphere surrounding the container 310 (i.e., the atmosphere of the refrigerated compartment). As will be described further below, the ventilation button 334 is adjustable between a collapsed configuration and expanded configuration to adjust an amount of ventilation therethrough.

Figure 22B:
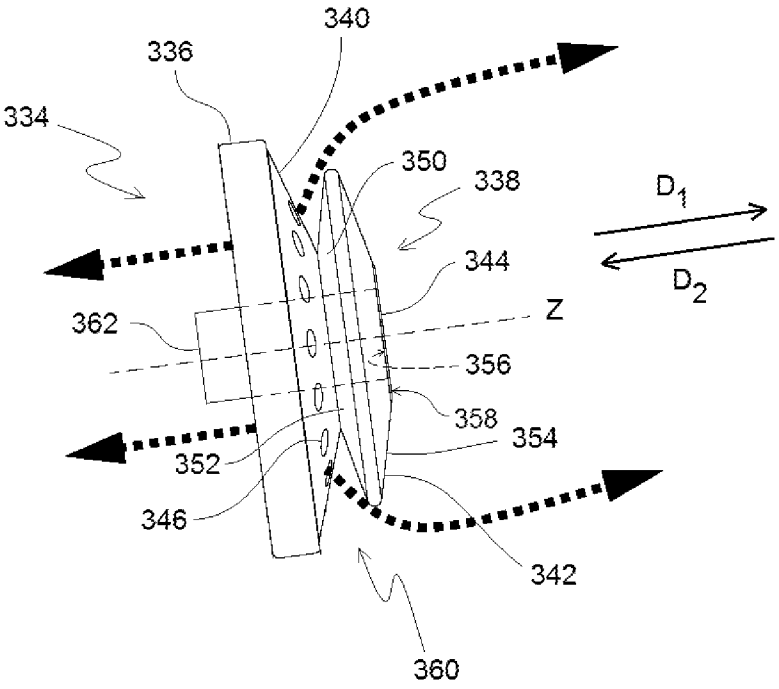
FIG. 22B is a side view of the ventilation button in an expanded configuration.
Figure 22A:
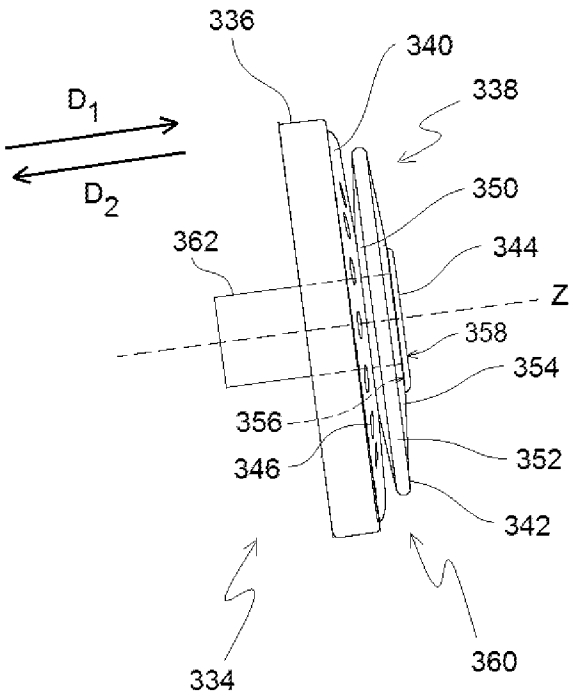
FIG. 22A is a side view of the ventilation button in a collapsed configuration.

As shown in FIGS. 22A & 22B, the ventilation button 334 includes a base 336 and a collapsible valve 338 attached to (e.g., integral with) the base 336. The collapsible valve 338 includes a skirt 340, a body 342, and a cap 344 that are concentrically arranged along an axis Z and aligned end-to-end. In particular, the body 342 connects the skirt 340 and cap 344 such that the body 342 is distal to the skirt 340 and proximal to the cap 344. (The terms "proximal" and "distal" as used herein when describing two features of the ventilation button 334 indicate a relative positioning of those two features along a path of connection to its base 336, the proximal feature being closer in connection to the base 336 than the distal feature. For example, because the body 342 is connected to the base 336 via the skirt 340, the skirt 340 is proximal to the body 342 while the body 342 is distal to the skirt 340. Meanwhile, because the cap 344 is connected to the base 336 via the body 342 and skirt 340, the body 342 and skirt 340 are proximal to the cap 344 while the cap 344 is distal to the body 342 and skirt 340).

The skirt 340 connects the base 336 and body 342 such that the skirt 340 is proximal to the body 342. The skirt 340 extends annularly about the axis Z and is tapered such that the skirt 340 decreases in diameter from its proximal end to its distal end. Furthermore, the valve 338 includes one or more apertures 346 circumferentially spaced about the axis Z that extend through the skirt 340 and can permit fluid (e.g., air) to communicate therethrough.

The body 342 includes an inner portion 350, a middle portion 352, and an outer portion 354 that are aligned end-to-end along the axis Z. In particular, the middle portion 352 connects the inner and outer portions 350, 354 such that the middle portion 352 is distal to the inner portion 350 and proximal to the outer portion 354. The portions 350, 352, 354 all extend annularly about the axis Z and are concentrically arranged along an axis Z. The inner portion 350 is tapered such that the inner portion 350 increases in diameter from its proximal end to its distal end. Meanwhile, the outer portion 354 is tapered such that the outer portion 354 decreases in diameter from its proximal end to its distal end. The middle portion 352 can have a substantially constant diameter that is contiguous with the diameters of the inner and outer portions 350, 354 at their points of attachment.

The cap 344 is a circular disk having an inner surface 356 and an outer surface 358. In some examples, the valve 338 can comprise a stem 362 that is concentrically arranged with the cap 344 along an axis Z and extends inward from the cap's inner surface 356 along the axis Z. The stem 362 can be substantially cylindrical in shape and can extend up to and beyond the base 336 of the ventilation button 334 along the axis Z. However, it is to be appreciated that the cap 344 and/or stem 362 can have different shapes and configurations in other examples.

The valve 338 is adjustable between a collapsed configuration (shown in FIG. 22A) and an expanded configuration (shown in FIG. 22B). When the valve 338 is in its expanded configuration, both the skirt 340 and body 342 are extended along the axis Z such that the valve 338 is relatively longer in dimension along the axis Z. Moreover, a spacing 360 between the skirt 340 and body 342 is provided that permits fluid to communicate through the apertures 346 in the skirt 340. Thus, the ventilation button 334 can provide ventilation through its apertures 346 when its valve 338 is in the expanded configuration. Meanwhile, when the valve 338 is in its collapsed configuration, both the skirt 340 and body 342 are collapsed along the axis Z such that the valve 338 is relatively short in dimension along the axis Z. Moreover, the spacing 360 between the skirt 340 and body 342 is reduced (e.g., decreased or eliminated) such that fluid communication through the apertures 346 is reduced (e.g., decreased or ceased) relative to fluid communication through the apertures 346 in the expanded configuration. Thus, ventilation through the apertures 346 can be reduced (e.g., decreased or ceased) when the valve 338 is in its collapsed configuration. In this manner, the amount of ventilation provided by the ventilation button 334 can be adjusted by altering the configuration of its valve 338 between its expanded and collapsed configurations.

In some examples, when the valve 338 is in its collapsed configuration, the body 342 of the valve 338 will abut against the skirt 340 and completely cover the apertures 346, prohibiting any fluid communication therethrough. In other examples, the body 342 will completely cover a proportion (i.e., less than all) of the apertures 346. Still in other examples, the body 342 will partially cover some or all of the apertures 346. Still further in some examples, the body 342 may not cover any aperture 346 but may nonetheless reduce fluid communication through one or more of the apertures 346 due to the reduction in spacing 360 between the body 342 and the skirt 340. The body 342 may assume a variety of arrangements relative to the skirt 340 that reduce fluid communication through one or more of the apertures 346 when the valve 338 is in its collapsed configuration.

To adjust the ventilation button 334 from its collapsed configuration to its expanded configuration, the body 342 of the ventilation button 334 can be pulled along a direction $D_1$ away from the button's base 336, thereby causing the button's valve 338 to expand. In addition or alternatively, the stem 362 of the ventilation button 334 can be pushed in the direction $D_1$ and against the inner surface 356 of the cap 344, thereby causing the button's valve 338 to expand.

To adjust the ventilation button 334 from its expanded configuration to its collapsed configuration, the cap 344 of the ventilation button 334 can be pushed in a direction $D_2$ toward the button's base 336, thereby causing the button's valve 338 to collapse. In addition or alternatively, the stem 362 of the ventilation button 334 can be pulled along the direction $D_2$ with its cap 344, thereby causing the button's valve 338 to collapse. Preferably, the ventilation button 334 is configured to be moved from its expanded configuration to its collapsed configuration, and vice-versa, by a user's hands and without the use of tools.

The components of the ventilation button 334 (e.g., base 336, skirt 340, body 342, cap 344, and stem 362) can each comprise a flexible material that permits the button 334 to assume its collapsed and expanded configurations. The flexible material can be, for example, natural or synthetic rubber, silicone, polyvinyl chloride, or some other synthetic plastic polymer. The components can be manufactured as a single piece or the components can be separately manufactured with similar or different materials and then attached to each other.

Figure 23B:
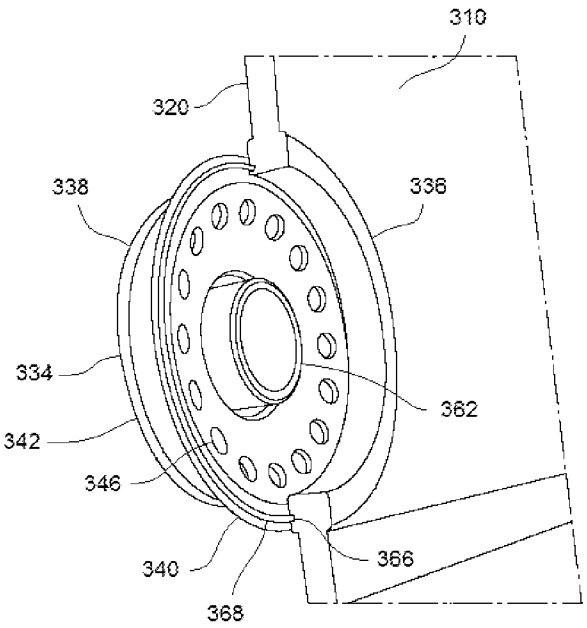
FIG. 23B is a partial cross-section view of the ventilation button having a base formed integrally with a wall of the container and a valve that is separately attached to the base.
Figure 23A:
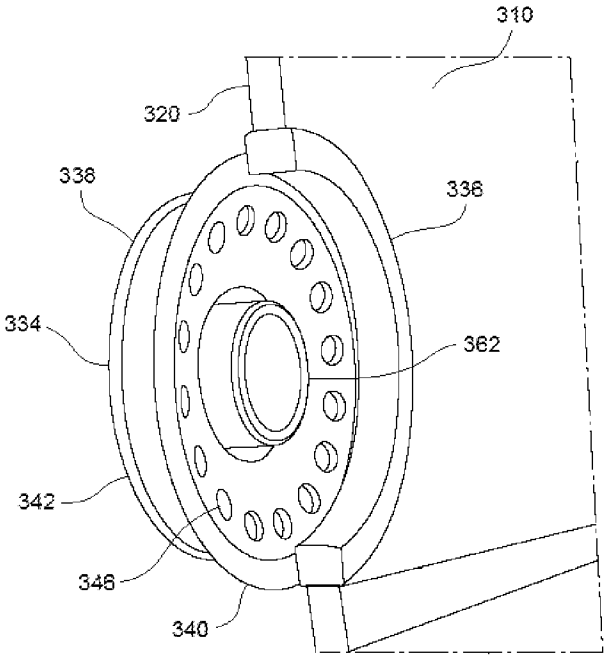
FIG. 23A is a partial cross-section view of the ventilation button co-molded in a wall of the container.
Figure 24A:
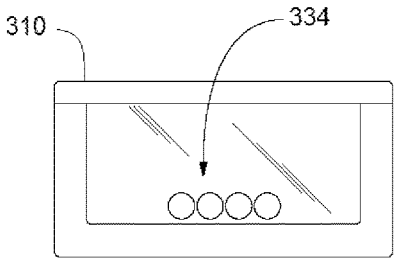
FIG. 24A is a front view of the container with a first arrangement of ventilation buttons.
Figure 24B:
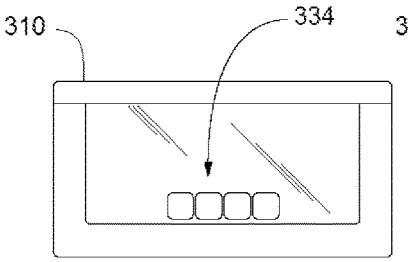
FIG. 24B is a front view of the container with a second arrangement of ventilation buttons.
Figure 24C:
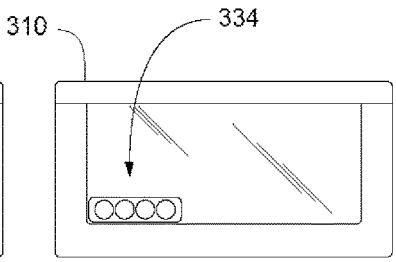
FIG. 24C is a front view of the container with a third arrangement of ventilation buttons.
Figure 24D:
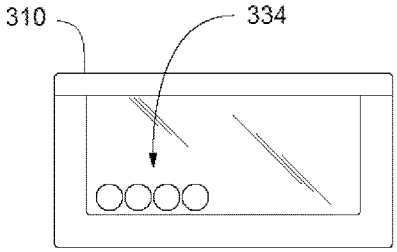
FIG. 24D is a front view of the container with a fourth arrangement of ventilation buttons.
Figure 24E:
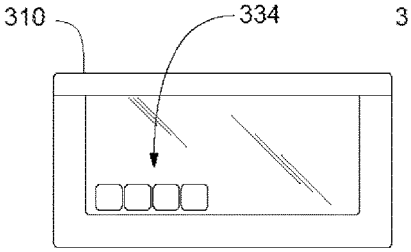
FIG. 24E is a front view of the container with a fifth arrangement of ventilation buttons.
Figure 24F:
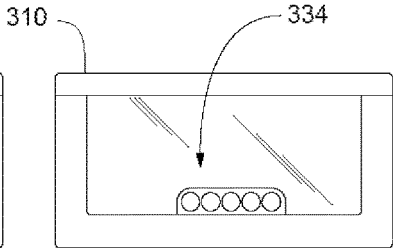
FIG. 24F is a front view of the container with a sixth arrangement of ventilation buttons.
Figure 24G:
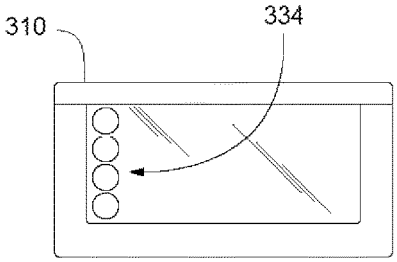
FIG. 24G is a front view of the container with a seventh arrangement of ventilation buttons.
Figure 24H:
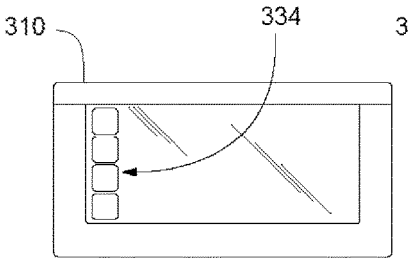
FIG. 24H is a front view of the container with an eighth arrangement of ventilation buttons.
Figure 24I:
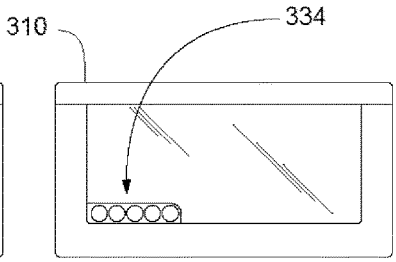
FIG. 24I is a front view of the container with a ninth arrangement of ventilation buttons.
Figure 24J:
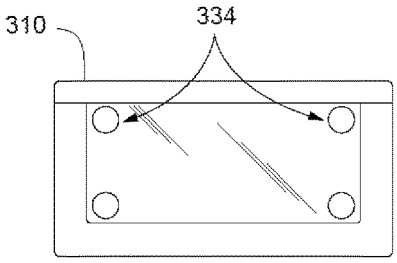
FIG. 24J is a front view of the container with a tenth arrangement of ventilation buttons.
Figure 24K:
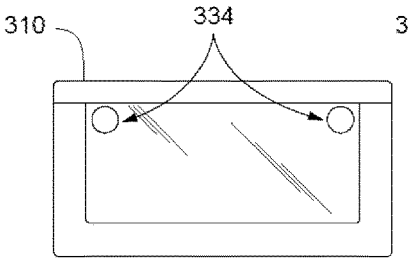
FIG. 24K is a front view of the container with an eleventh arrangement of ventilation buttons.
Figure 24L:
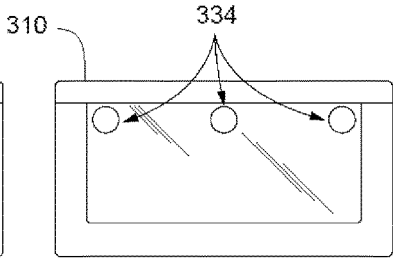
FIG. 24L is a front view of the container with a twelfth arrangement of ventilation buttons.

In some examples, the ventilation button 334 can be a single piece that is co-molded in one of the walls (e.g., front wall 320) of the container 310, as shown in FIG. 23A. In other examples, the base 336 of the ventilation button 334 can be formed integrally with one of the walls (e.g., front wall 320) while the valve 338 of the ventilation button 334 can be separately attached to the base 336, as shown in FIG. 23B. In such examples, the base 336 can define an annular groove 366 and the valve 338 can comprise an annular protrusion 368 that mates with and engages the annular groove 366 to removably attach the valve 338 to the base 336. However, the valve 338 can be separately attached to the base 336 using a variety of different structure/methods such as, for example, adhesive, welding, fasteners, etc.

The ventilation button 334 can be mounted to one of the walls (e.g., front wall 320) of the container 310 such that the button's valve 338 projects outward from the wall and the outer surface 358 of the button's cap 344 faces away from the container's enclosure 330, as shown in FIG. 21. When mounted as such, the ventilation button 334 can be adjusted from its collapsed configuration to its expanded configuration by pulling the body 342 of the ventilation button 334 outward and away from the wall. Moreover, the ventilation button 334 can be adjusted from its expanded configuration to its collapsed configuration by pushing the cap 344 toward the wall.

In other examples, the ventilation button 334 can be mounted to one of the walls (e.g., front wall 320) of the container 310 such that the button's valve 338 projects inward from the wall into the container's enclosure 330. When mounted as such, the ventilation button 334 can be adjusted from its collapsed configuration to its expanded configuration by pulling the body 342 of the ventilation button 334 inward and away from the wall. Moreover, the ventilation button 334 can be adjusted from its expanded configuration to its collapsed configuration by pushing the cap 344 toward the wall.

The ventilation button 334 can be mounted to any wall of the container 310. For example, the ventilation button 334 can be mounted to the front wall 320, as shown in FIG. 21. Alternatively, the ventilation button 334 can be mounted to the rear wall 322 or one of the side walls 324, 326 of the container 310 to help hide the ventilation button 334 from view. Mounting the ventilation button 334 to the rear wall 322 or one of the side walls 324, 326 can also help avoid collision of the ventilation button 334 against structure on the doors 24, 26 of the refrigerator assembly 10 and/or reduce the need to clean the ventilation button 334.

In some examples, the container 310 can include a plurality of ventilation buttons 334. The plurality of ventilation buttons 334 can be arranged about the container 310 in a variety of different shapes and configurations. FIGS. 24A-24L illustrate various example arrangements of the ventilation buttons 334. As shown in FIGS. 24A-24L, one or more of the ventilation buttons 334 of the present disclosure can have a circle, oval, square or oblong shape, or other desired geometry. Moreover, one or more of the ventilation buttons 334 can be provided side by side in a vertical line or a horizontal line. One or more of the ventilation buttons 334 can be provided on a top portion or a bottom portion of the container 310. Some shapes and arrangements of the ventilation buttons 334 are more suitable for specific sizes, shapes, and positions of the container for user-friendliness. The ventilation buttons 334 can also be apart from each other such as, for example, in each corner of a wall of the container 310.

Figure 25:
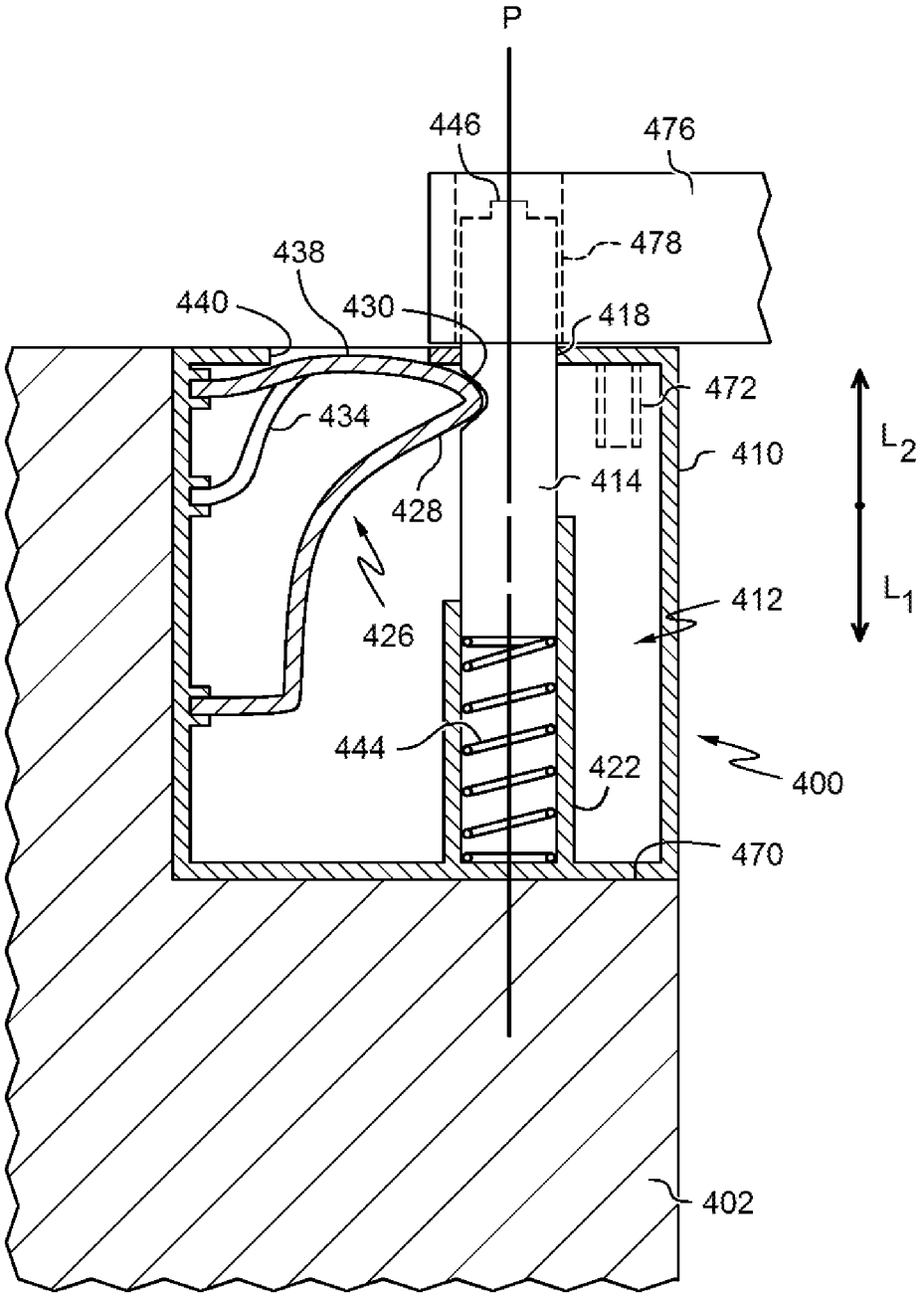
FIG. 25 is a partial cross-section view of a hinge assembly of the example refrigerator assembly with an actuator of the hinge assembly in a first state.

Turning to FIG. 25, the refrigerator assembly 10 in some examples can include a hinge assembly 400 for pivotally coupling a door 402 (e.g., one of doors 24, 26, 28) of the refrigerator assembly 10 to its cabinet 12. As will be described further below, the hinge assembly 400 is a modular unit that can be mounted at various locations on the door 402 to permit different mounting configurations for the door 402.

More specifically, the hinge assembly 400 includes a housing 410 that defines an enclosure 412. The hinge assembly 400 further includes a hinge pin 414 that is axially movable within the enclosure 412 along an axis P. The hinge pin 414 can extend through an aperture 418 defined by the housing 410 such that a portion of the hinge pin 414 protrudes from the housing 410. Moreover, the hinge assembly 400 can further include a channel 422 within the enclosure 412 that axially receives the hinge pin 414 and can guide the hinge pin 414 along the axis P. The channel 422 can be integrally formed with the housing 410 or the channel 422 can be a separate element that is separately attached to the housing 410 within its enclosure 412.

The hinge assembly 400 can include one or more features for controlling (e.g., actuating, limiting, biasing, resisting, inhibiting, etc.) the axial movement of the hinge pin 414 along the axis P. For instance, the hinge assembly 400 can include an actuator 426 that is located at least partially within the enclosure 412 and is adjustable between a first state (shown in FIG. 25) and a second state (shown in FIG. 26). The actuator 426 includes a projection 428 that is configured to engage a detent 430 provided along the hinge pin 414. The detent 430 can be an annular recess that extends about the entire circumference of the hinge pin 414 or the detent 430 can be a recess that extends only partially about the circumference of the hinge pin 414. As the actuator 426 is adjusted between its first and second states, the projection 428 will apply a force to the hinge pin 414 that moves the hinge pin 414 along the axis P. In particular, as the actuator 426 is adjusted from its first state to its second state, the hinge pin 414 will move along the axis $P_1$ in a first linear direction $L_1$ from an extended position (shown in FIG. 25) to a retracted position (shown in FIG. 26). Meanwhile, as the actuator 426 is adjusted from its second state to its first state, the hinge pin 414 will move along the axis $P_1$ in a second linear direction $L_2$ opposite to the first direction $L_1$ from its retracted position to its extended position.

The actuator 426 can be biased toward the first state shown in FIG. 25. For instance, the actuator 426 can include a spring element 434 (e.g., a leaf spring) that biases the actuator 426 toward its first state. In addition or alternatively, the actuator 426 can comprise an elastic material that permits the actuator to flex between its first and second states and biases the actuator 426 toward the first state. The actuator 426 in the illustrated embodiment is cantilevered from a side wall of the housing 410 such that the actuator 426 can flex between its first and second states. However, in other examples, the actuator 426 may be a rigid or non-rigid member that is rotatably attached to the housing 410 such that the actuator 426 is rotatable between its first and second states. The actuator 426 can comprise any rigid or non-rigid member that is adjustable between first and second states to control the axial position of the hinge pin 414 along the axis P.

In order to adjust the actuator 426 from its first state to its second state, the actuator 426 can include an engagement portion 438 that can be engaged (e.g., pushed) to adjust the actuator 426. In particular, a user can engage the engagement portion 438 by pressing the engagement portion 438 with one or more fingers to state the actuator 426 from its first state to its second state. When the user ceases engagement with the engagement portion 438, the bias of the actuator 426 will cause the actuator 426 to return to its first state.

The housing 410 can include an aperture 440 that permits a user to access the engagement portion 438. In some examples, the engagement portion 438 can extend through the aperture 440 when the actuator 426 is in its first state such that the engagement portion 438 is flush with or projects from the housing 410. In particular, the engagement portion 438 can extend through the aperture 440 such that the engagement portion 438 substantially closes the aperture 440 to inhibit a majority of small-to-large macroscopic particles from entering through the aperture 440 while unintentionally allowing microscopic and very small macroscopic particles to enter through the aperture 440. In other examples, the engagement portion 438 can be recessed within the enclosure 412 of the housing 410 when the actuator 426 is in its first state.

Figure 26:
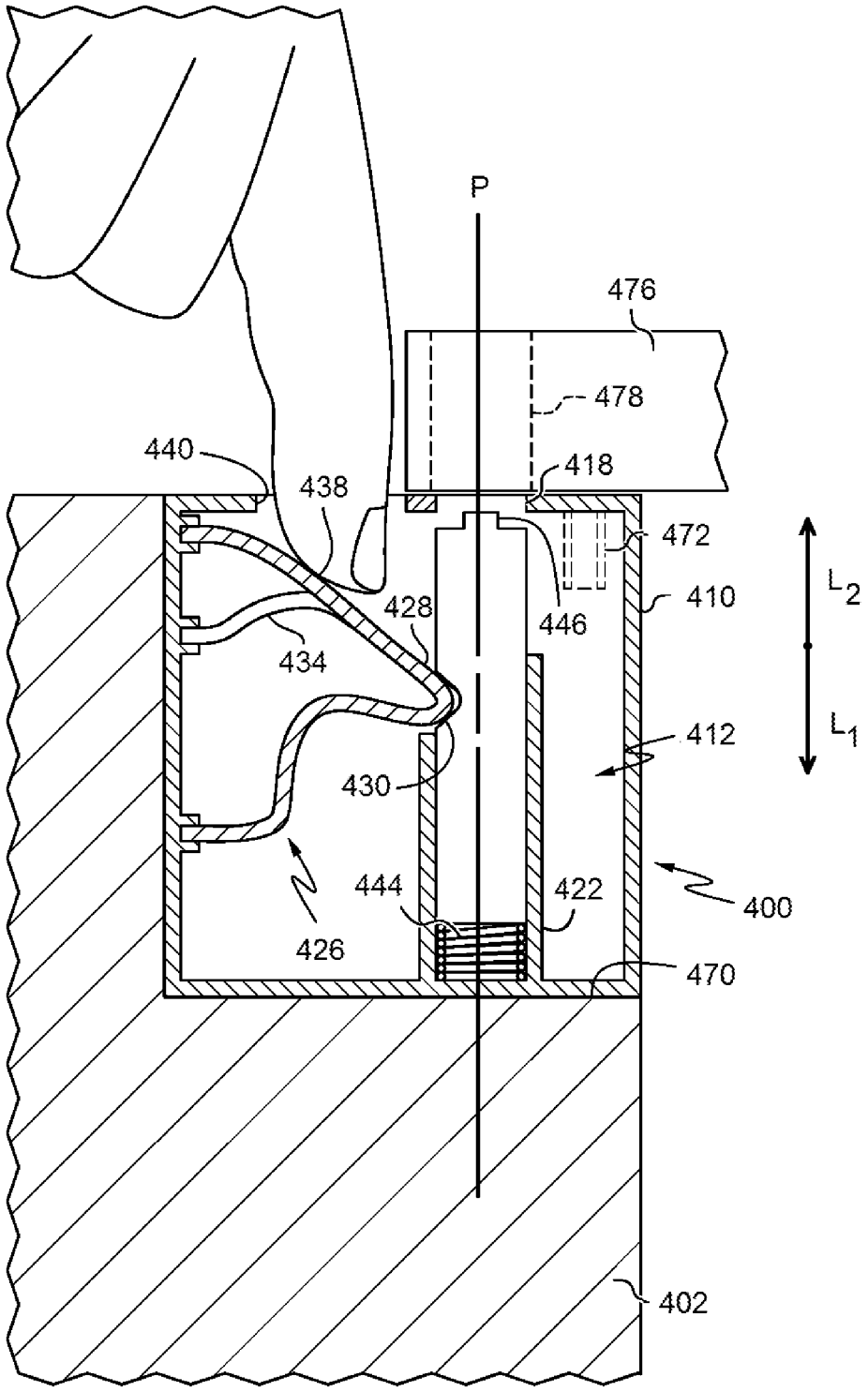
FIG. 26 is a partial cross-section view of the hinge assembly with the actuator in a second state.

In some examples, the hinge assembly 400 can comprise a spring element 444 (e.g., a coiled spring) that can bias the hinge pin 414 in the second linear direction $L_2$ toward its extended position. The spring element 444 can reside within the channel 422 and can be aligned axially with the hinge pin 414 along the axis P such that as the hinge pin 414 is moved in the first linear direction $L_1$, the hinge pin 414 can engage and compress the spring element 444, as shown in FIG. 26. The compressed spring element 444 will exert a counterforce on the hinge pin 414 to bias the hinge pin 414 in the second linear direction $L_2$ toward its extended position.

In some examples, the hinge pin 414 itself can comprise an engagement portion 446 that can be engaged (e.g., pushed or pulled) by a user to control movement of the hinge pin 414 along the axis P. In the present example, the engagement portion 446 extends axially from a top surface of the hinge pin 414 and comprises a rib that is rectangular in cross-section and extends longitudinally across the top surface, thereby providing a structure that can be easily grasped by a user to control movement of the hinge pin 414. However, the engagement portion 446 may comprise any shape or arrangement that can be engaged by a user to control movement of the hinge pin 414 along the axis P. Indeed, the engagement portion 446 can correspond to any part of the hinge pin 414 that is located outside of the housing 410 and can be engaged to control movement of the hinge pin 414 along the axis P.

Figure 27:
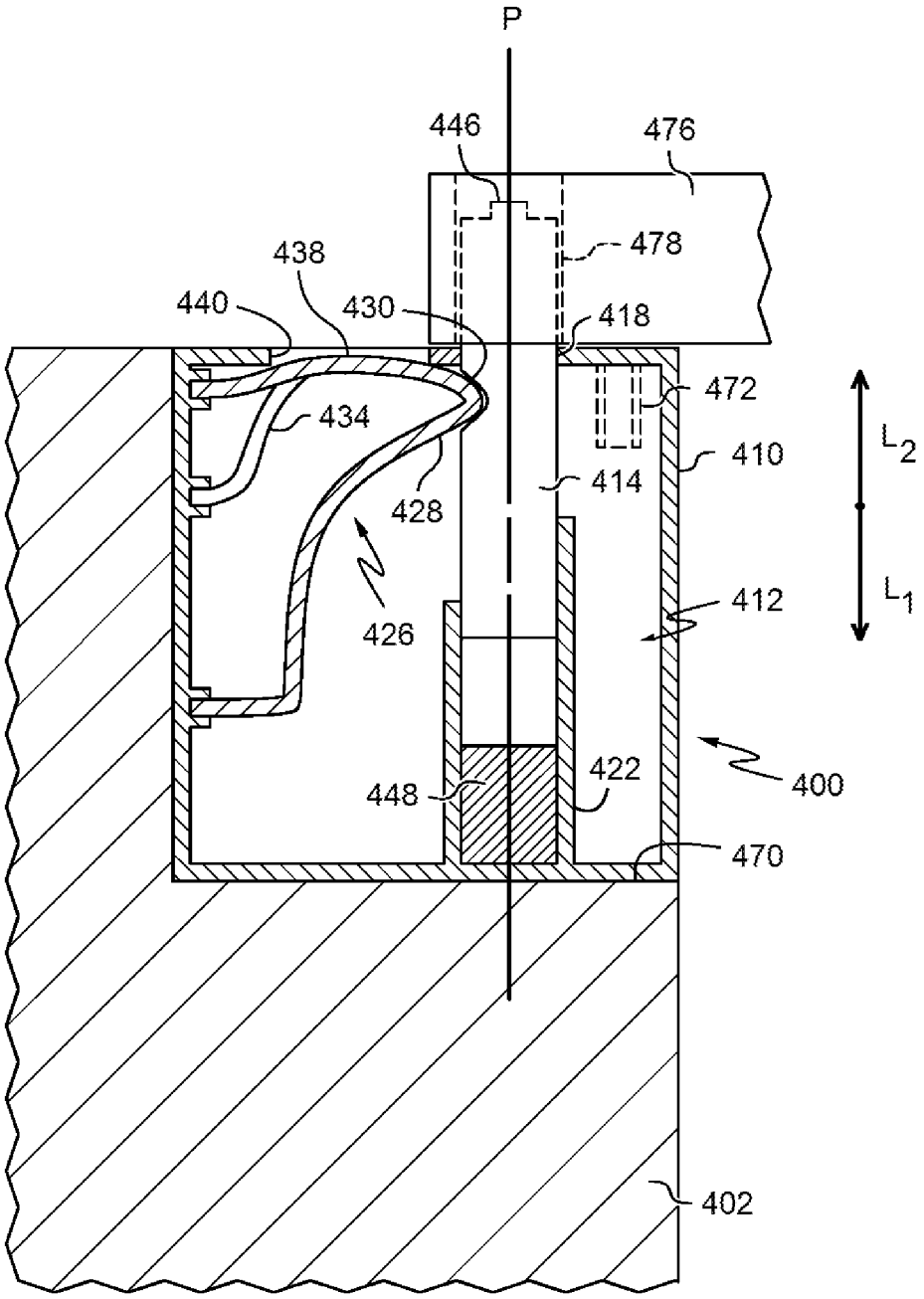
FIG. 27 is a partial cross-section view of the hinge assembly with a stop element.

In some examples, the hinge assembly 400 can comprise a stop element 448 (as shown in FIG. 27) that is configured to limit axial movement of the hinge pin 414 in the first linear direction $L_1$. The stop element 448 can reside within the channel 422 and can be aligned axially with the hinge pin 414 along the axis P such that as the hinge pin 414 is moved in the first linear direction $L_1$, the hinge pin 414 will engage the stop element 448, thereby limiting the hinge pin 414 from further movement in the first linear direction $L_1$. In some examples, intermediate structure (e.g., the spring element 444) can be provided between the hinge pin 414 and the stop element 448 such that the hinge pin 414 indirectly engages the stop element 448.

Figure 28:
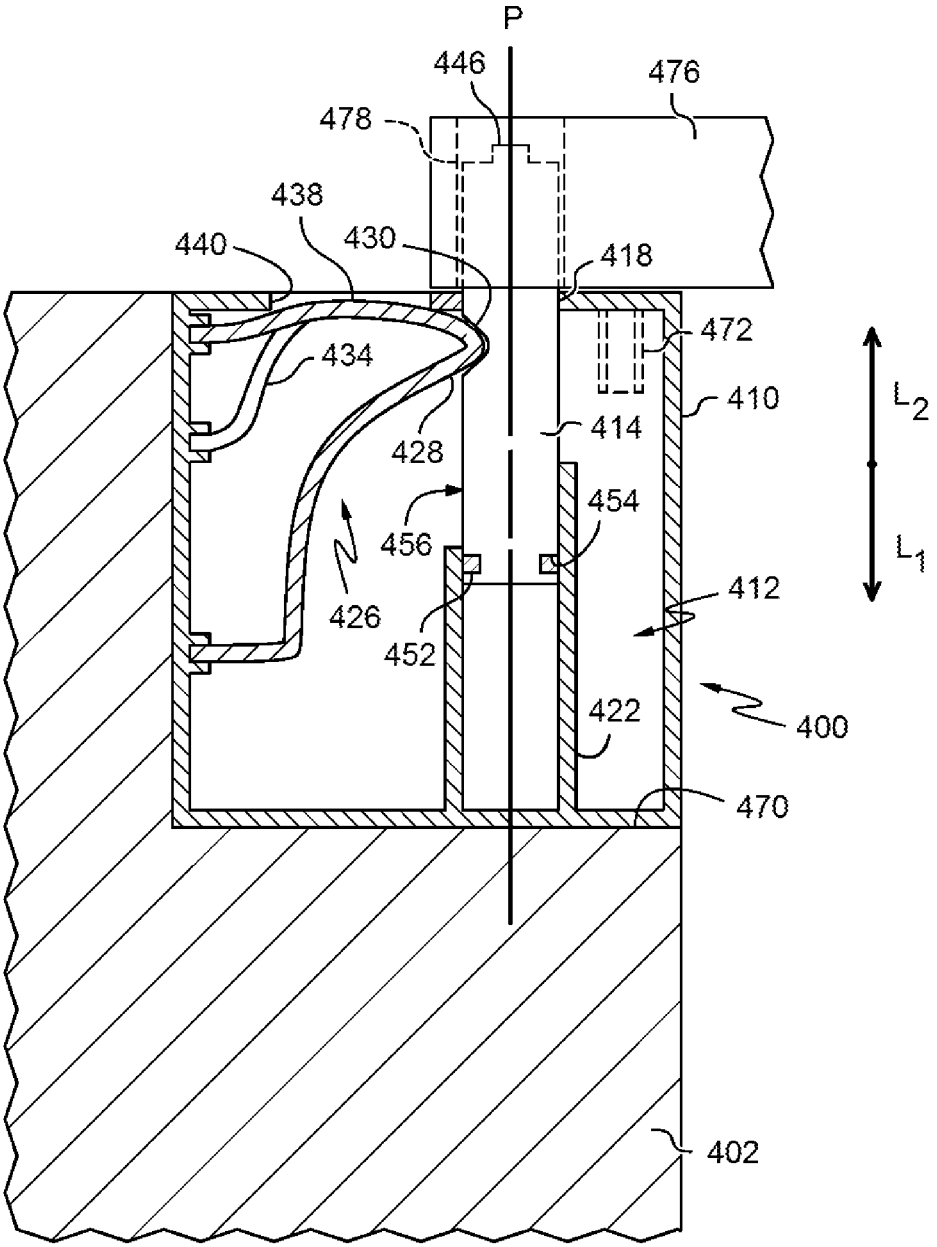
FIG. 28 is a partial cross-section view of the hinge assembly with a gasket.

In some examples, the hinge assembly 400 can comprise a gasket 452 that is configured to inhibit axial movement of the hinge pin 414 along the axis P, as shown in FIG. 28. The gasket 452 may be fixed to one of the hinge pin 414 and the channel 422 such that the gasket 452 frictionally engages the other of the hinge pin 414 and the channel 422 to resist movement of the hinge pin 414 along the axis P. In the illustrated example, the gasket 452 is located within an annular recess 454 defined by an outer surface 456 of the hinge pin 414, thereby fixing the gasket 452 relative to the hinge pin 414. However, the gasket 452 in other examples may reside within an annular recess defined by an inner surface of the channel 422, thereby fixing the gasket 452 relative to the channel 422. The gasket 452 can comprise any configuration that provides frictional engagement between the hinge pin 414 and channel 422 to resist movement of the hinge pin 414 along the axis P.

Figure 29:
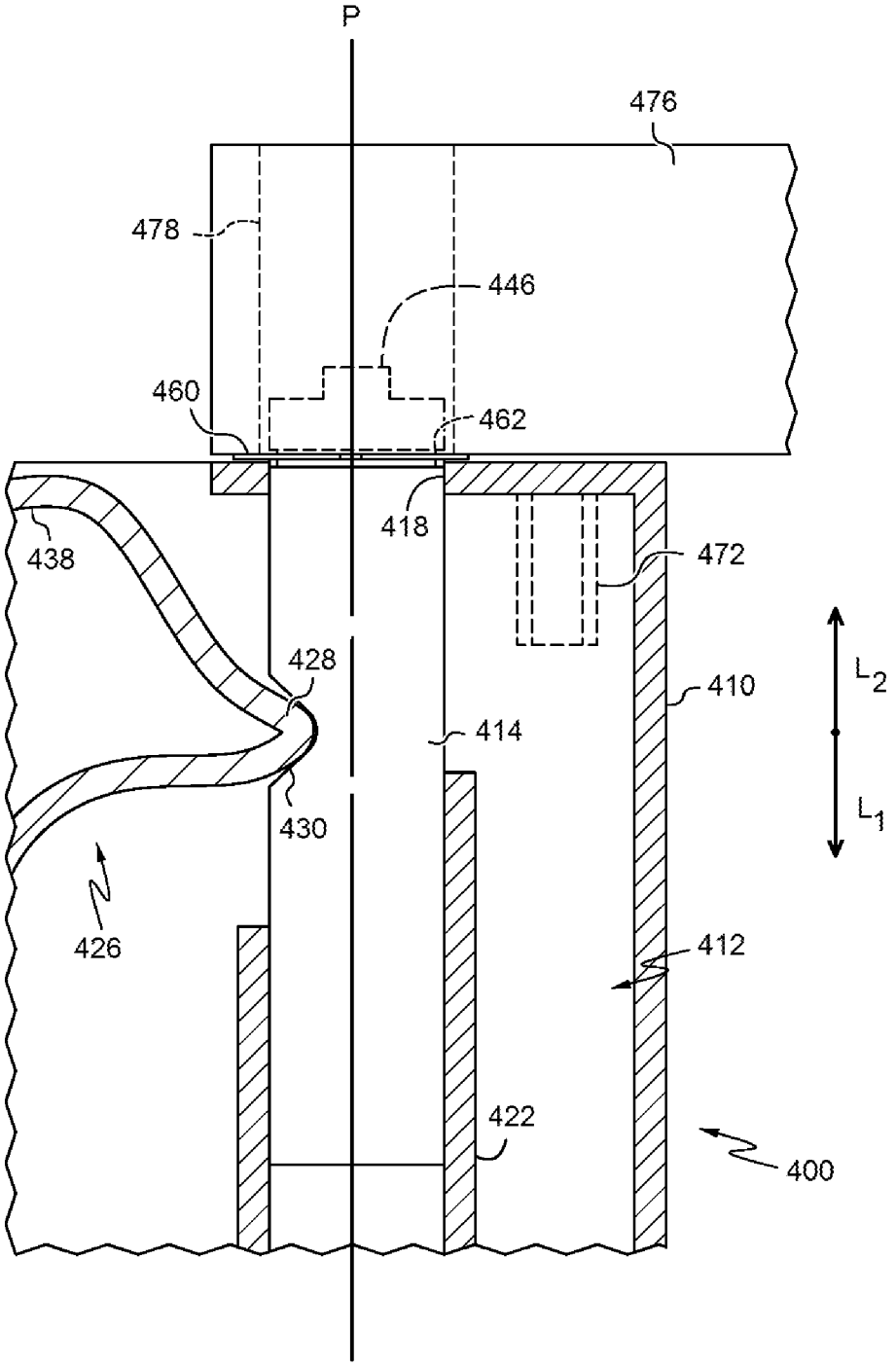
FIG. 29 is a partial cross-section view of the hinge assembly with a retaining ring.

In some examples, the hinge assembly 400 can comprise a retaining ring 460 fixed to the hinge pin 414 that is configured to limit axial movement of the hinge pin 414 along the axis P, as shown in FIG. 29. The retaining ring 460 can be received within an annular recess 462 that extends about the circumference of the hinge pin 414, thereby fixing the retaining ring 460 to the hinge pin 414. Alternatively, the retaining ring 460 can be integrally formed with the hinge pin 414. The retaining ring 460 can be fixed in a variety of manners to the hinge pin 414.

The retaining ring 460 is greater in diameter than the hinge pin 414 and can be located along the hinge pin 414 such that as the hinge pin 414 is moved along the axis P, the retaining ring 460 will engage one or more structures to limit further movement of the hinge pin 414. For instance, in the illustrated example, the retaining ring 460 is located on a portion of the hinge pin 414 that extends outside of the housing 410. As the hinge pin 414 is moved in the first linear direction $L_1$, the retaining ring 460 will engage a top side of the housing 410 and limit further movement of the hinge pin 414 in the first linear direction $L_1$. In other examples, the retaining ring 460 may be located on a portion of the hinge pin 414 that resides within the housing 410. In such examples, the retaining ring 460 may engage a bottom side of the housing 410 to limit movement of the hinge pin 414 in the second linear direction $L_2$. Alternatively, the retaining ring 460 may engage the channel 422 to limit movement of the hinge pin 414 in the first linear direction $L_1$. The retaining ring 460 may engage a variety of different structure as the hinge pin 414 is moved along the axis P to limit further movement of the hinge pin 414.

The hinge assembly 400 can comprise any one or more of the features described above for controlling the axial movement of the hinge pin 414 along the axis P. In this manner, the axial movement of the hinge pin 414 can be controlled to permit installation and/or removal of the hinge assembly 400 and the door 402 to the cabinet 12 of the refrigerator assembly 10, as described further below.

More specifically, the hinge assembly 400 can be received within a pocket 470 defined by the door 402, as shown in FIG. 25. The housing 410 of the hinge assembly 400 can be removably fixed to the door 402 using, for example, one or more fasteners that threadably couple the housing 410 to the door 402. For instance, the fasteners may be threadably inserted within a coupling portion 472 of the housing 410. In other examples, the housing 410 may be secured within the pocket 470 by insulating foam that is injected into the pocket 470. The housing 410 can be fixed to the door 402 in a variety of manners without departing from the scope of the invention.

A hinge bracket 476 can be coupled to the cabinet 12 of the refrigerator assembly 10 that defines an aperture 478 for receiving the hinge pin 414 of the hinge assembly 400. In particular, once the hinge assembly 400 is mounted to the door 402, the hinge pin 414 can be received within the aperture 478 of the hinge bracket 476, thereby inhibiting movement of the door 402 relative to the hinge bracket 476 that is transverse (e.g., perpendicular) to the axis P.

To facilitate insertion of the hinge pin 414 within the aperture 478 of the hinge bracket 476, the axial movement of the hinge pin 414 along the axis P can be controlled using one or more of the features described above. For instance, the actuator 426 can be adjusted from its first state to its second state to retract the hinge pin 414 while aligning the aperture 478 with the hinge pin 414. Once aligned, the actuator 426 can be adjusted from its second state to its first state to move the hinge pin 414 along the axis P to its extended position and into the aperture 478. The spring element 444, engagement portion 446, stop element 448, gasket 452, retaining ring 460, or some combination thereof can act to further control axial movement of the hinge pin 414 during insertion of the hinge pin 414 within the aperture 478 of the hinge bracket 476. For instance, the spring element 444 can bias the hinge pin 414 along the second linear direction $L_2$ into the aperture 478. As another example, the stop element 448 can prevent the hinge pin 414 from moving past its retracted position during installation. As yet another example, the gasket 452 can inhibit axial movement of the hinge pin 414, which can be particularly advantageous if the hinge assembly 400 assumes an upside-down orientation wherein the hinge pin 414 may fall out of the housing 410. As yet another example, the retaining ring 460 can provide a limit to axial movement of the hinge pin 414 in the first linear direction $L_1$ and/or the second linear direction $L_2$. As yet another example, the engagement portion 446 on the hinge pin 414 can be engaged to adjust the position of the hinge pin 414 along the axis P.

In some examples, the hinge bracket 476 can be fixed to the cabinet 12 and the hinge pin 414 can rotatably engage the aperture 478 of the hinge bracket 476 to permit rotation of the door 402 relative to the cabinet 12. For instance, the hinge pin 414 and the aperture 478 of the hinge bracket 476 can be circular at their interface to permit the hinge pin 414 and door 402 to rotate relative to the hinge bracket 476 about the axis P.

In other examples, the hinge pin 414 and the aperture 478 of the hinge bracket 476 can be non-circular (e.g., hexagonal) at their interface such that the hinge pin 414 is prohibited from rotating relative to the hinge bracket 476 about the axis P. In such examples, the hinge pin 414 may be rotatable relative to the housing 410 and/or the hinge bracket 476 may be rotatable relative to the cabinet 12 to permit rotation of the door 402 relative to the cabinet 12.

Preferably, the door 402 can include pockets 470 at multiple locations of the door 402 to permit different mounting configurations for the door 402. For instance, as shown in FIG. 25, the door 402 can include one pocket 470 at an upper-right corner of the door 402 that one hinge assembly 400 can be mounted within to rotatably couple the upper-right corner to the cabinet 12. The door 402 can further include a second pocket 470 at its lower-right corner that a second hinge assembly 400 can be mounted within to rotatably couple the lower-right corner to the cabinet 12. The lower hinge assembly 400 will have an orientation that is flipped vertically relative to the orientation of the upper hinge assembly 400. Moreover, the refrigerator assembly 10 can comprise upper and lower hinge brackets 476 on the right side of its cabinet 12 that are associated and engage with the upper and lower hinge assemblies 400. In this manner, the door 402 can be rotatably coupled to the cabinet 12 such that the door 402 rotates along its right side.

In addition or alternatively, the door 402 can include one pocket 470 at an upper-left corner of the door 402 that one hinge assembly 400 can be mounted within to rotatably couple the upper-left corner to the cabinet 12. The door 402 can further include a pocket 470 at its lower-left corner that another hinge assembly 400 can be mounted within to rotatably couple the lower-left corner to the cabinet 12. The lower hinge assembly 400 will have an orientation that is flipped vertically relative to the orientation of the upper hinge assembly 400. Moreover, the refrigerator assembly 10 can comprise upper and lower hinge brackets 476 on the left side of its cabinet 12 that are associated and engage with the upper and lower hinge assemblies 400. In this manner, the door 402 can be rotatably coupled to the cabinet 12 such that the door 402 rotates along its left side.

The hinge assembly 400 described above is designed such that the same assembly can be mounted at various pockets 470 of the door 402 by adjusting the orientation of the hinge assembly 400 (e.g., flipping the hinge assembly 400 vertically and/or horizontally) according to the orientation of the respective pocket 470. Thus, there is no need to manufacture and provide different hinge assemblies for different pockets 470. Furthermore, because the hinge assembly 400 is modular, the hinge assembly 400 can be easily removed from one pocket 470 and installed at another pocket 470, thus making it easier to change mounting configurations for the door 402.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. A refrigerator assembly comprising:

a cabinet defining a storage compartment;

a pair of doors for providing selective access to the storage compartment, the pair of doors including a first door and a second door, wherein the first door is pivotally attached to the cabinet such that the first door is rotatable between an open position and a closed position; and a mullion assembly comprising:

a hinge coupled to the first door, a flipper mullion pivotally attached to the hinge such that the flipper mullion is rotatable relative to the hinge about an axis, wherein the flipper mullion is rotatable between a first position, a second position, and an intermediate position that is intermediate the first and second positions, and a magnetic assembly configured to bias the flipper mullion toward the second position, wherein the magnetic assembly comprises a magnetic hinge body coupled to the hinge and a magnetic mullion body coupled to the flipper mullion, wherein the hinge comprises a first side that faces the flipper mullion and an opposing second side that faces away from the flipper mullion and towards a mounting surface of the first door, wherein the second side of the hinge defines a recess, the recess being a blind hole, and wherein the magnetic hinge body is provided within the recess.

2. The refrigerator assembly according to claim 1, wherein the flipper mullion comprises a mullion casing defining an enclosure and the magnetic mullion body is provided within the enclosure.

3. The refrigerator assembly according to claim 1, further comprising a cabinet guide coupled to the cabinet and a mullion guide provided at an end of the flipper mullion, wherein:

the cabinet guide is configured to guide the mullion guide of flipper mullion as the first door is rotated from the closed position to the open position such that the flipper mullion rotates from the first position to the second position, and the cabinet guide is configured to guide the mullion guide of the flipper mullion as the first door is rotated from the open position to the closed position such that the flipper mullion rotates from the second position to the first position.

4. The refrigerator assembly according to claim 3, further comprising a second magnetic assembly configured to bias the flipper mullion toward the first position.

5. The refrigerator assembly according to claim 4, wherein the second magnetic assembly comprises a magnetic cabinet body coupled to the cabinet guide and a magnetic mullion body coupled to the flipper mullion.

6. The refrigerator assembly according to claim 5, wherein the flipper mullion comprises a mullion casing defining an enclosure and the magnetic mullion body is provided within the enclosure.

7. The refrigerator assembly according to claim 5, wherein the magnetic mullion body is provided in the mullion guide of the flipper mullion.

8. The refrigerator assembly according to claim 1, wherein the mullion assembly is changeable between a first configuration wherein the flipper mullion is pivotally attached to the first door and a second configuration wherein the flipper mullion is pivotally attached to the second door.

9. The refrigerator assembly according to claim 8, wherein:

in the first configuration, the flipper mullion is pivotally attached to the first door in a first orientation, and in the second configuration, the flipper mullion is pivotally attached to the second door in a second orientation that is upside-down relative to the first orientation.

10. The refrigerator assembly according to claim 8, wherein the at least one hinge comprises a first hinge attached to the first door and a second hinge attached to the second door, further wherein:

in the first configuration, the flipper mullion is pivotally attached to the first hinge in a first orientation, and in the second configuration, the flipper mullion is pivotally attached to the second hinge in a second orientation that is upside-down relative to the first orientation.

11. The refrigerator assembly according to claim 8, wherein:

in the first configuration, the hinge is removably attached to the first door in a first orientation, and in the second configuration, the hinge is removably attached to the second door in a second orientation that is upside-down relative to the first orientation.

12. The refrigerator assembly according to claim 11, wherein the hinge includes an aperture, the first door includes a first set of wiring, and the second door includes a second set of wiring, further wherein:

in the first configuration, the first set of wiring extends through the aperture, and in the second configuration, the second set of wiring extends through the aperture.

13. The refrigerator assembly according to claim 12, wherein the flipper mullion includes a resistive heater having an electrical coupling, further wherein:

in the first configuration, the first set of wiring is connected to the electrical coupling, and in the second configuration, the second set of wiring is connected to the electrical coupling.

14. The refrigerator assembly according to claim 8, wherein the flipper mullion comprises a first end having a first mullion guide and a second end having a second mullion guide.

15. The refrigerator assembly according to claim 14, further comprising at least one cabinet guide attached or attachable to the cabinet, wherein:

in the first configuration, the at least one cabinet guide is configured to engage and guide the first mullion guide as the first door is moved between the open position and the closed position, and in the second configuration, the at least one cabinet guide is configured to engage and guide the second mullion guide as the second door is moved between another open position and another closed position.

16. The refrigerator assembly according to claim 15, wherein the at least one cabinet guide comprises a first cabinet guide and a second cabinet guide that are removably attachable to the cabinet, further wherein:

in the first configuration, the first cabinet guide is attached to the cabinet and configured to engage and guide the first mullion guide as the first door is moved between its open position and closed position, and in the second configuration, the second cabinet guide is attached to the cabinet and configured to engage and guide the second mullion guide as the second door is moved between its open position and closed position.

17. The refrigerator assembly according to claim 1, wherein the magnetic hinge body is enclosed by the hinge and the first door such that the magnetic hinge body is concealed from view when the first door is in the open position.

18. The refrigerator assembly according to claim 1, further comprising a spring, wherein the spring is configured to bias the flipper mullion toward the first position when the flipper mullion is between the first position and the intermediate position, further wherein the spring is configured to bias the flipper mullion toward the second position when the flipper mullion is between the second position and the intermediate position.

19. The refrigerator according to claim 1, wherein:

the first side of the hinge faces a first direction towards the flipper mullion and the second side of the hinge faces a second direction away from the flipper mullion, the second direction opposite to the first direction, and the blind hole has an open end and a closed end, the blind hole extending from the open end to the closed end in the first direction.

20. A mullion assembly comprising:

a hinge;

a flipper mullion pivotally attached to the hinge such that the flipper mullion is rotatable relative to the hinge about an axis, wherein the flipper mullion is rotatable between a first position, a second position, and an intermediate position that is intermediate the first and second positions; and a magnetic assembly configured to bias the flipper mullion toward the second position, wherein the magnetic assembly comprises a magnetic hinge body coupled to the hinge and a magnetic mullion body coupled to the flipper mullion, wherein the hinge comprises a first side that faces the flipper mullion and an opposing second side that faces away from the flipper mullion, wherein the second side of the hinge defines a recess, the recess being a blind hole, and wherein the magnetic hinge body is provided within the recess.

21. The mullion assembly according to claim 20, further comprising a spring, wherein the spring is configured to bias the flipper mullion toward the first position when the flipper mullion is between the first position and the intermediate position, further wherein the spring is configured to bias the flipper mullion toward the second position when the flipper mullion is between the second position and the intermediate position.

22. The mullion assembly according to claim 20, wherein:

the first side of the hinge faces a first direction towards the flipper mullion and the second side of the hinge faces a second direction away from the flipper mullion, the second direction opposite to the first direction, and the blind hole has an open end and a closed end, the blind hole extending from the open end to the closed end in the first direction.

23. A refrigerator assembly comprising: a cabinet defining a storage compartment; a pair of doors for providing selective access to the storage compartment, the pair of doors including a first door and a second door, wherein the first door is pivotally attached to the cabinet such that the first door is rotatable between an open position and a closed position; a hinge coupled to the first door; a flipper mullion pivotally attached to the hinge such that the flipper mullion is rotatable relative to the hinge about an axis, wherein the flipper mullion is rotatable between a first position and a second position; a cabinet guide coupled to the cabinet, wherein: the cabinet guide is configured to guide the mullion guide of the flipper mullion as the first door is rotated from the closed position to the open position such that the flipper mullion rotates from the first position to the second position, and the cabinet guide is configured to guide the mullion guide of the flipper mullion as the first door is rotated from the open position to the closed position such that the flipper mullion rotates from the second position to the first position; and a magnetic assembly configured to bias the flipper mullion toward the first position as the first door is rotated to the closed position, wherein the magnetic assembly comprises a magnetic cabinet body coupled to the cabinet guide and a magnetic mullion body coupled to the flipper mullion.

24. A mullion assembly comprising:

a hinge; and a flipper mullion pivotally attached to the hinge such that the flipper mullion is rotatable relative to the hinge about an axis, wherein the flipper mullion is rotatable between a first position and a second position, wherein the flipper mullion comprises an elongated main body having first and second end surfaces on opposite ends of the elongated main body, the first end surface facing a first direction and the second end surface facing a second direction opposite to the first direction, wherein the flipper mullion comprises a mullion guide that extends from the first end surface in the first direction, and wherein the flipper mullion comprises a magnetic mullion body provided in the mullion guide of the flipper mullion such that the magnetic mullion body is located in the first direction from the first end surface.

* * * * *